US010065206B2

(12) United States Patent
Atsebha et al.

(10) Patent No.: US 10,065,206 B2
(45) Date of Patent: Sep. 4, 2018

(54) SYSTEMS, METHODS, AND APPARATUSES FOR APPLYING VISCOUS FLUIDS TO COMPONENTS

(71) Applicant: The Boeing Company, Chicago, IL (US)

(72) Inventors: Solomon Atsebha, Seattle, WA (US); Mark Blumenkrantz, Huntington Beach, CA (US); John Walter Pringle, IV, Gardena, CA (US)

(73) Assignee: The Boeing Company, Chicago, IL (US)

( * ) Notice: Subject to any disclaimer, the term of this patent is extended or adjusted under 35 U.S.C. 154(b) by 8 days.

(21) Appl. No.: 14/703,779

(22) Filed: May 4, 2015

(65) Prior Publication Data

US 2016/0325307 A1 Nov. 10, 2016

(51) Int. Cl.

| | |
|---|---|
| ***B05B 1/00*** | (2006.01) |
| ***B05C 5/02*** | (2006.01) |
| *B05C 17/005* | (2006.01) |
| *B05B 13/02* | (2006.01) |

(52) U.S. Cl.

CPC ..... *B05C 5/0212* (2013.01); *B05C 5/0204* (2013.01); *B05B 13/0207* (2013.01); *B05B 13/0278* (2013.01); *B05C 17/00589* (2013.01)

(58) Field of Classification Search

None

See application file for complete search history.

(56) References Cited

U.S. PATENT DOCUMENTS 3,408,979 A * 11/1968 Torwegge ..... B05C 5/0204 118/325
3,954,548 A * 5/1976 Polit ..... B42C 9/0056 156/477.1
3,967,581 A * 7/1976 Zirbel ..... B05C 5/0204 118/410

(Continued)

FOREIGN PATENT DOCUMENTS

DE 951478 C 10/1956
DE 202008003757 U1 9/2009

(Continued)

OTHER PUBLICATIONS

European Patent Office, Extended European Search Report in European Patent Application No. 16162094.3-1760, dated Aug. 10, 2016, 6 pages.

(Continued)

*Primary Examiner* — Charles Capozzi
(74) *Attorney, Agent, or Firm* — Kolisch Hartwell, P.C.

(57) ABSTRACT

Systems, apparatuses, and methods for applying viscous fluid to a component having a primary surface and opposed surfaces perpendicular to the primary surface may include positioning an adjustable nozzle adjacent the primary surface such that first and second contact members of the nozzle, movable relative to each other, contact the opposed surfaces, the first and second contact members being urged toward the opposed surfaces by at least one biasing element of the adjustable nozzle, applying a viscous fluid from a passage in a body of the adjustable nozzle to the primary surface, and moving the adjustable nozzle along the primary surface.

11 Claims, 16 Drawing Sheets

(56) References Cited

U.S. PATENT DOCUMENTS

| | | | | |
|---|---|---|---|---|
| 4,512,945 | A * | 4/1985 | Vigano | B42C 9/0006 118/410 |
| 4,778,642 | A | 10/1988 | Lee et al. | |
| 4,965,362 | A | 10/1990 | Dominguez | |
| 5,271,794 | A * | 12/1993 | Jarrell | B42C 9/0006 156/538 |
| 5,908,644 | A | 6/1999 | Poole | |
| 6,001,181 | A | 12/1999 | Bullen | |
| 7,963,246 | B1 | 6/2011 | Brinker | |
| 8,651,046 | B1 | 2/2014 | Davancens et al. | |
| 9,016,530 | B2 | 4/2015 | Topf et al. | |
| 2002/0097926 | A1 * | 7/2002 | Mochizuki | B23Q 1/40 384/58 |
| 2008/0128430 | A1 | 6/2008 | Kovach et al. | |
| 2012/0180718 | A1 * | 7/2012 | Martin | B05C 5/0204 118/108 |
| 2013/0207348 | A1 | 8/2013 | Smeets | |
| 2016/0279863 | A1 | 9/2016 | Trend et al. | |

FOREIGN PATENT DOCUMENTS

| | | | |
|---|---|---|---|
| EP | 0889108 | A1 | 1/1999 |
| EP | 2837430 | A2 | 2/2015 |
| GB | 2524508 | A | 9/2015 |
| WO | 0226397 | A1 | 4/2002 |
| WO | 2012084238 | A1 | 6/2012 |
| WO | 2014063806 | A1 | 5/2014 |
| WO | 2014179015 | A1 | 11/2014 |

OTHER PUBLICATIONS

U.K. Intellectual Property Office, Combined Search and Examination Report under Sections 17 and 18(3) in UK Patent Application No. GB1609279.3, dated Nov. 10, 2016, 6 pages.

U.S. Patent and Trademark Office, Nonpublished U.S. Appl. No. 14/703,806, filed May 4, 2015, by Applicant, The Boeing Company.

* cited by examiner

SYSTEMS, METHODS, AND APPARATUSES FOR APPLYING VISCOUS FLUIDS TO COMPONENTS

FIELD

This disclosure relates to the application of viscous fluids to components. More specifically, disclosed embodiments relate to systems, apparatuses, and methods for the application of viscous fluids to components having complex geometries, such as varying widths and/or contours.

INTRODUCTION

Viscous fluids, such as sealants, adhesives, and/or uncured polymers, may be applied on various components. For example, sealants may be applied to composite materials to assemble tanks and/or to insulate edges, such as to mitigate the electrical properties of the composite materials and to prevent electrostatic discharge. Those components may, however, have complex geometries, such as varying widths and/or contours. Viscous fluids have been manually applied to the components to manage their complex geometries. For example, brushes and/or rollers may be used to manually apply (or apply by hand) the viscous fluid to the components. However, such manual or hand application is generally tedious, time consuming, and produces finished components with variable quality.

SUMMARY

The present disclosure provides an adjustable nozzle for applying viscous fluid to a component having a primary surface and opposed surfaces perpendicular to the primary surface. In some embodiments, the adjustable nozzle may include a body having a passage for receiving a viscous fluid. In some embodiments, the adjustable nozzle may include first and second opposed side members at least partially received in the passage and movably connected to the body. In some embodiments, the adjustable nozzle may include a first contact element attached to the first side member, and a second contact element attached to the second side member. In some embodiments, the adjustable nozzle may include at least one biasing element attached to the side members and configured to urge the side members toward each other.

The present disclosure provides a method of applying a viscous fluid to a component having a primary surface and opposed surfaces perpendicular to the primary surface. In some embodiments, the method may include positioning an adjustable nozzle adjacent the primary surface such that first and second contact members of the nozzle, movable relative to each other, contact the opposed surfaces. The first and second contact members may be urged toward the opposed surfaces by at least one biasing element of the adjustable nozzle. In some embodiments, the method may include applying a viscous fluid from a passage in a body of the adjustable nozzle to the primary surface. In some embodiments, the method may include moving the adjustable nozzle along the primary surface.

The present disclosure provides a system for applying a viscous fluid to a component having a primary surface and opposed surfaces perpendicular to the primary surface. In some embodiments, the system may include a robotic arm. In some embodiments, the system may include a controller assembly configured to control the robotic arm. In some embodiments, the system may include an adjustable nozzle attached to the robotic arm. In some embodiments, the adjustable nozzle may include a body including a passage for receiving a viscous fluid and having an output opening for discharging the viscous fluid on the component. In some embodiments, the nozzle may include first and second opposed side members at least partially received in the passage and movably connected to the body. In some embodiments, the nozzle may include a first contact element attached to the first side member, and a second contact element attached to the second side member. In some embodiments, the nozzle may include at least one biasing element attached to the side members and configured to urge the side members toward each other. In some embodiments, the side members may be configured to adjust the size of the output opening responsive to variations in distance between the opposed surfaces of the component along a path defined by the primary surface of the component.

Features, functions, and advantages may be achieved independently in various embodiments of the present disclosure, or may be combined in yet other embodiments, further details of which can be seen with reference to the following description and drawings.

DESCRIPTION

Overview

Figure 1:
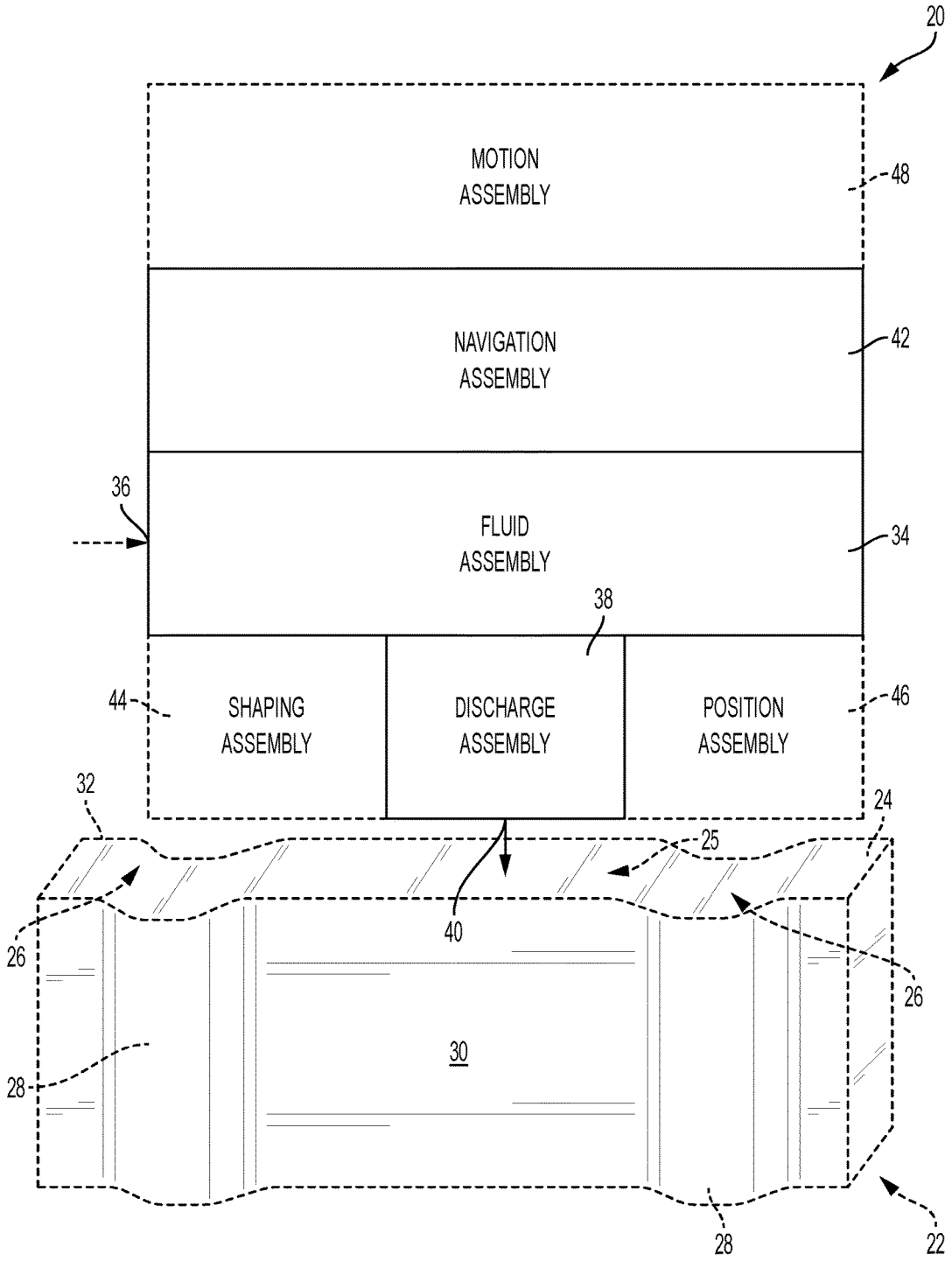
FIG. 1 is a block diagram of an illustrative system and an illustrative component.

Various embodiments of systems, apparatuses, and methods for applying viscous fluids are described below and illustrated in the associated drawings. Unless otherwise specified, a system, an apparatus, or a method and/or their various components may, but are not required to, contain at least one of the structures, components, functionality, and/or variations described, illustrated, and/or incorporated herein. Furthermore, the structures, components, functionalities, and/or variations described, illustrated, and/or incorporated herein in connection with the systems, apparatuses, and methods may, but are not required to, be included in other similar systems, apparatuses, or methods. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

DEFINITIONS

"Bead" refers to viscous fluid that is supported by and/or on a component after application of a viscous fluid to the component by the systems, apparatuses, and methods of viscous fluid application of the present disclosure. The bead may have any suitable cross-sectional shape and/or dimensions, such as any suitable aspect ratio. For example, the bead may have a low-aspect ratio cross-section (e.g., one or more thick layers) or a high-aspect ratio cross-section (e.g., one or more thin layers). The bead may be supported on one or more surfaces of a component, such as on only a primary surface, on only a primary surface and one or more opposed surfaces, etc.

"Biasing element" refers to an element configured to continuously apply a force, which may have a constant or variable magnitude.

"Component" refers to any object or structure that may include a single part (or piece) or may include multiple parts (or pieces). For example, a component may refer to a composite material having two or more constituent materials with significantly different physical or chemical properties. The constituent materials may include a matrix (or bond) material, such as a resin (e.g., thermoset epoxy) and a reinforcement material, such as a plurality of fibers (e.g., a woven layer of carbon fibers).

"Primary surface" refers to any surface (of a component) that has been selected to receive a viscous fluid.

"Viscous fluid" refers to a flowable material having a viscosity sufficient to substantially retain shape in the absence of applied stress. For example, viscous fluids may be formed into a bead having a selected cross section. Viscous fluids may include semisolid materials. Examples of viscous fluids include certain caulks, sealants, epoxies, adhesives, and the like.

EXAMPLES, COMPONENTS, AND ALTERNATIVES

The following sections describe selected aspects of exemplary systems, apparatuses, and methods for applying viscous fluids to components as well as related systems, apparatuses, and/or methods. The examples in these sections are intended for illustration and should not be interpreted as limiting the scope of the present disclosure. Each section may include one or more distinct examples, and/or contextual or related information, function, and/or structure.

Example 1

This example describes an illustrative viscous fluid application system 20 and an illustrative component 22; see FIG. 1.

Component 22 may include a primary surface 24. Primary surface 24 may have a constant width or may have varying widths. Additionally, primary surface 24 may have one or more straight portions 25 and one or more curved portions 26. Curved portion(s) 26 may be formed from one or more contours 28 of component 22. Curved portions 26 may be within the plane of the straight portions of primary surface 24, outside the plane of those portions, or any suitable combination. Component 22 may include opposed surfaces 30 and 32, which may be perpendicular or substantially perpendicular to primary surface 24. In some examples, component 22 may intersect with opposed surfaces 30 and 32. In other examples, one or more surfaces may be disposed between primary surface 24 and one or both of opposed surfaces 30 and 32.

Viscous fluid application system 20 may include a fluid assembly 34. Fluid assembly 34 may include any suitable structure configured to receive and/or contain a viscous fluid. In some examples, fluid assembly 34 may receive viscous fluid through an inlet or input port 36.

Viscous fluid application system 20 may include a discharge assembly 38. Discharge assembly 38 may include any suitable structure configured to discharge or apply viscous fluid to component 22. Discharge assembly 38 may be fluidly connected to fluid assembly 34 and may discharge viscous fluid received and/or contained in the fluid assembly to component 22 via an outlet or output opening 40. In some examples, discharge assembly 38 may adjust one or more properties of outlet 40 based on one or more properties of component 22. For example, discharge assembly 38 may adjust an area or width of outlet 40 based on, or responsive to, variations of the area or width of primary surface 24 of component 22.

Viscous fluid application system 20 may include a navigation assembly 42. Navigation assembly 42 may include any suitable structure configured to guide discharge assembly 38 along primary surface 24, such as along straight portion(s) 25 and curved portion(s) 26 of that surface, while the discharge assembly is applying viscous fluid.

Viscous fluid application system 20 may include a shaping assembly 44. Shaping assembly 44 may include any suitable structure configured to shape at least a portion of a bead of a viscous fluid applied to component 22. The shaping assembly may be configured to shape any suitable portion(s) of the bead in any suitable shapes, such as various convex and/or concave shapes.

Viscous fluid application system 20 may include a position assembly 46. Position assembly 46 may include any suitable structure configured to place outlet 40 of discharge assembly 38 at a suitable position and orientation to apply a viscous fluid on component 22. For example, position assembly 46 may ensure that outlet 40 is parallel to primary surface 24 and/or is at an optimum distance from the primary surface.

Viscous fluid application system 20 may include a motion assembly 48. Motion assembly 48 may include any suitable structure configured to move one or more other components of system 20 along component 22, such as along primary surface 24. In some examples, motion assembly 48 may be configured to deliver viscous fluid to fluid assembly 34, such as while moving the other components of system 20 along component 22. One or more components of viscous fluid application system 20 may be common between two or more of the above assemblies. For example, navigation assembly 42 and position assembly 46 may have one or more contact members common between those assemblies.

Example 2

Figure 2:
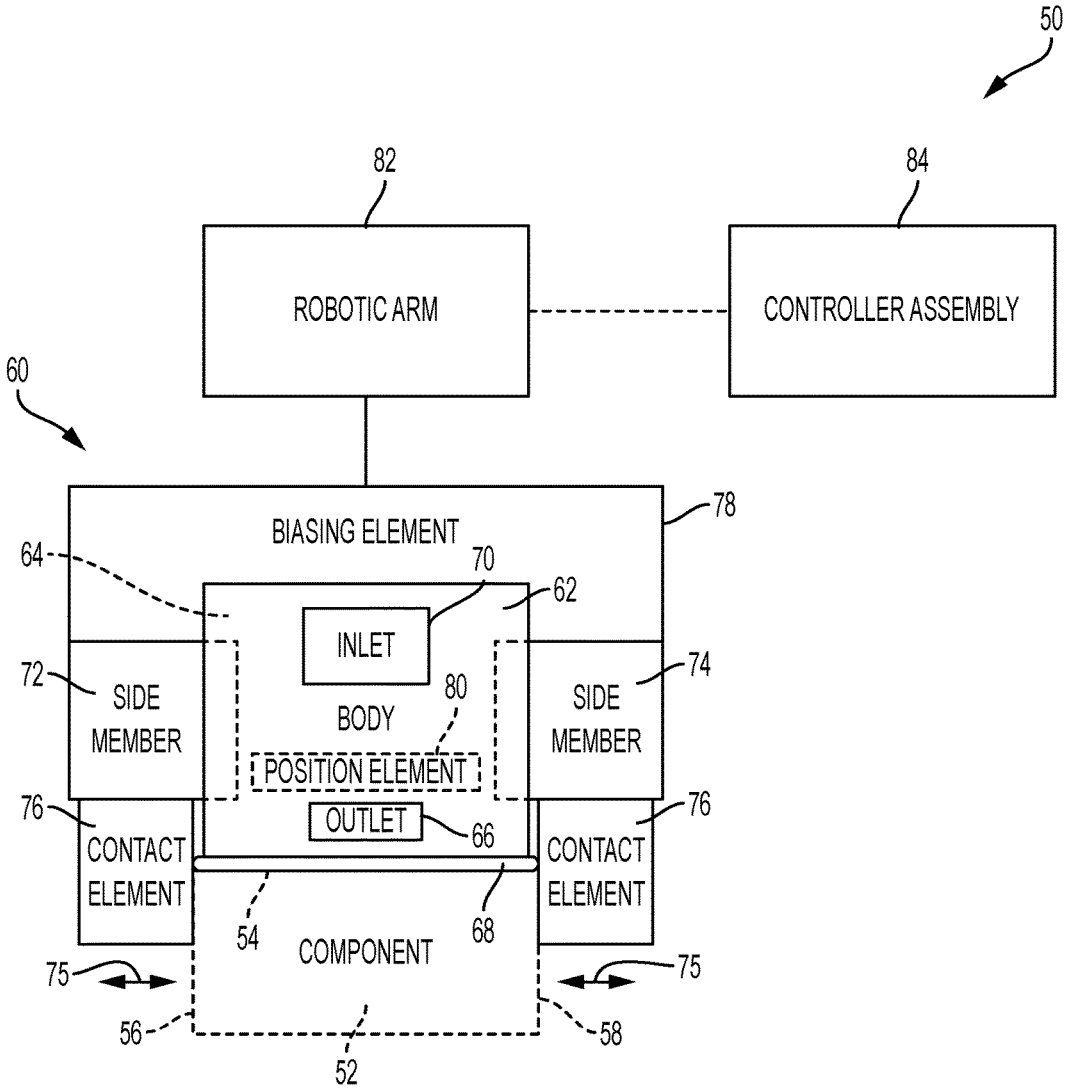
FIG. 2 is a block diagram of an illustrative system and an illustrative component.
Figure 3:
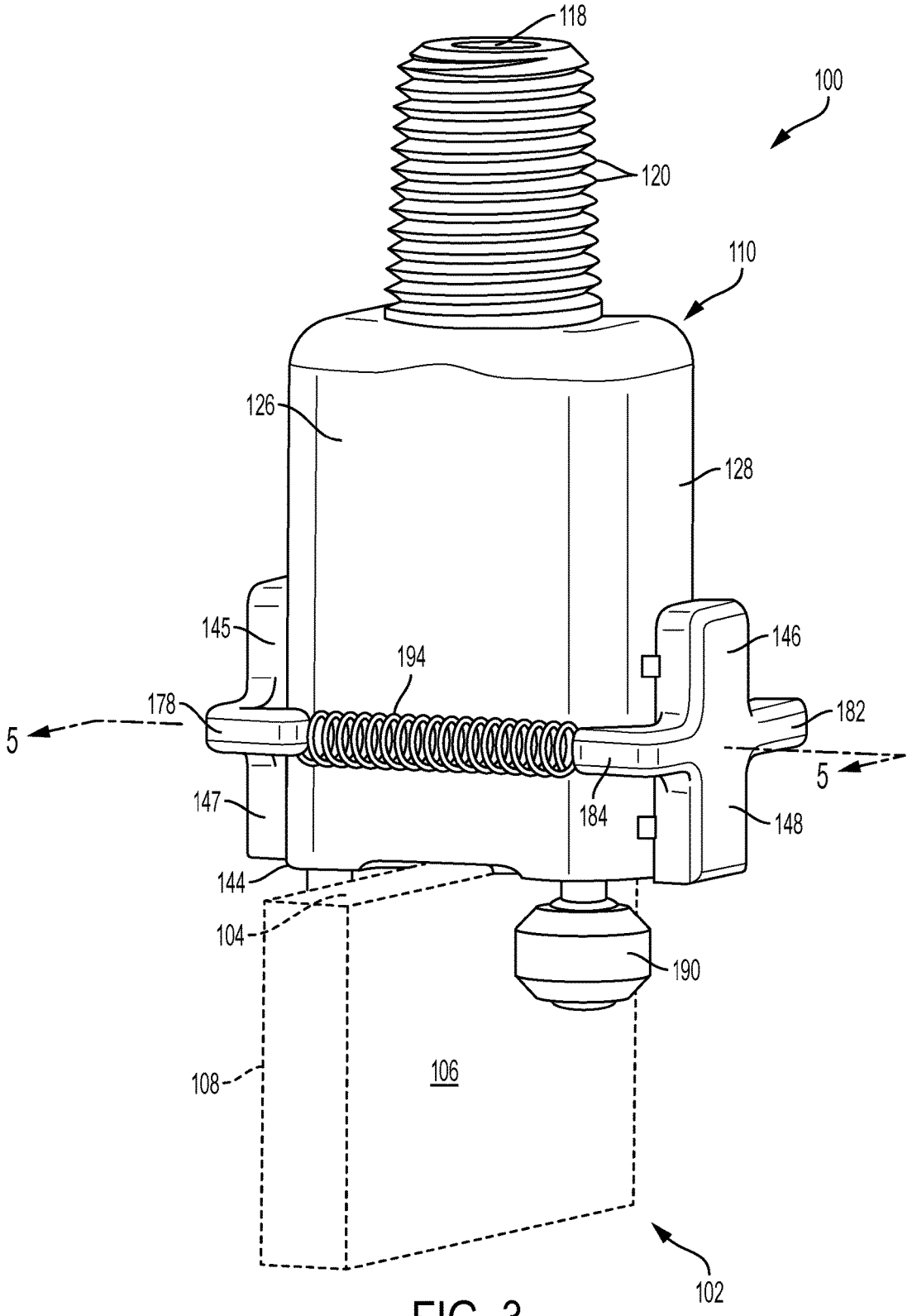
FIG. 3 is a perspective view of an illustrative apparatus and an illustrative component.
Figure 4:
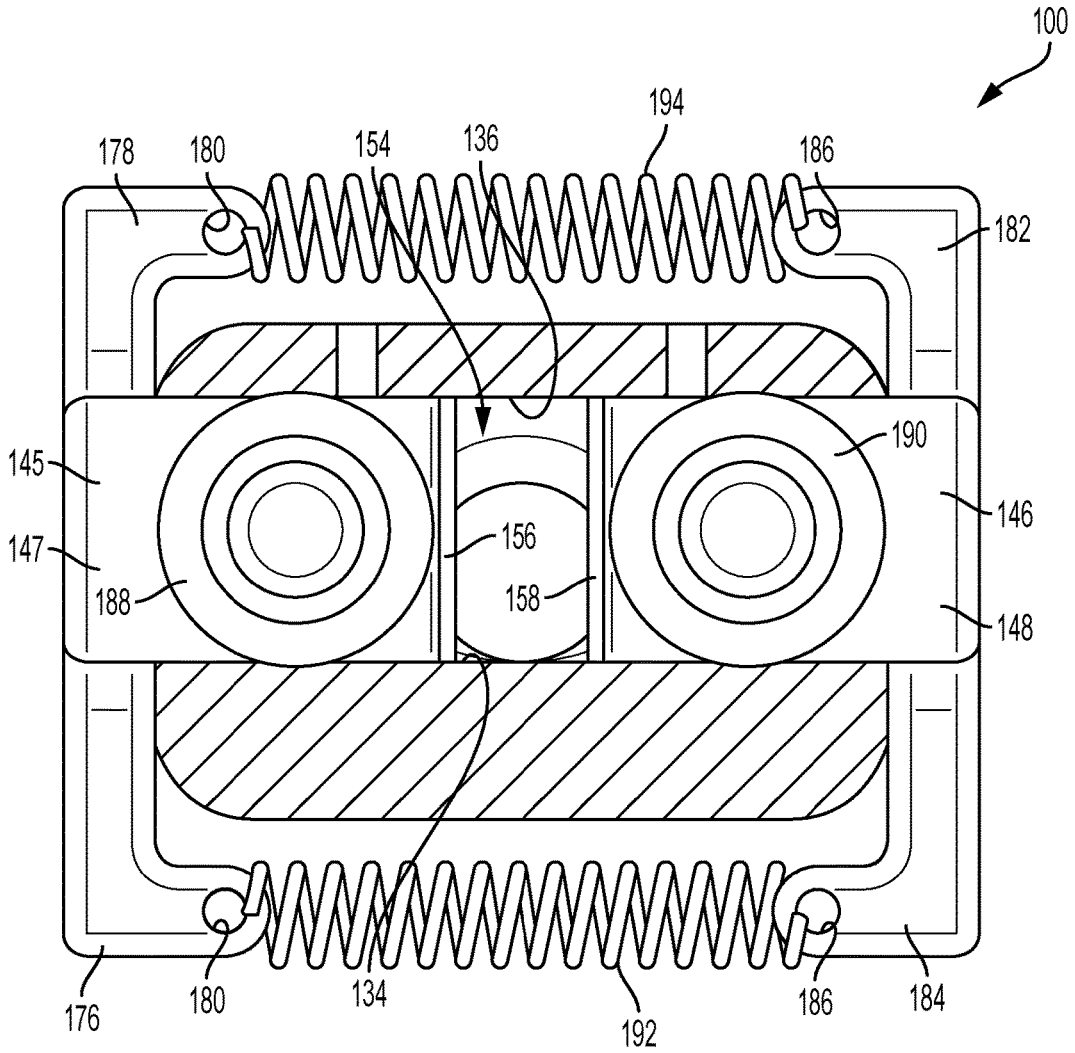
FIG. 4 is a bottom view of the illustrative apparatus of FIG. 3.
Figure 5:
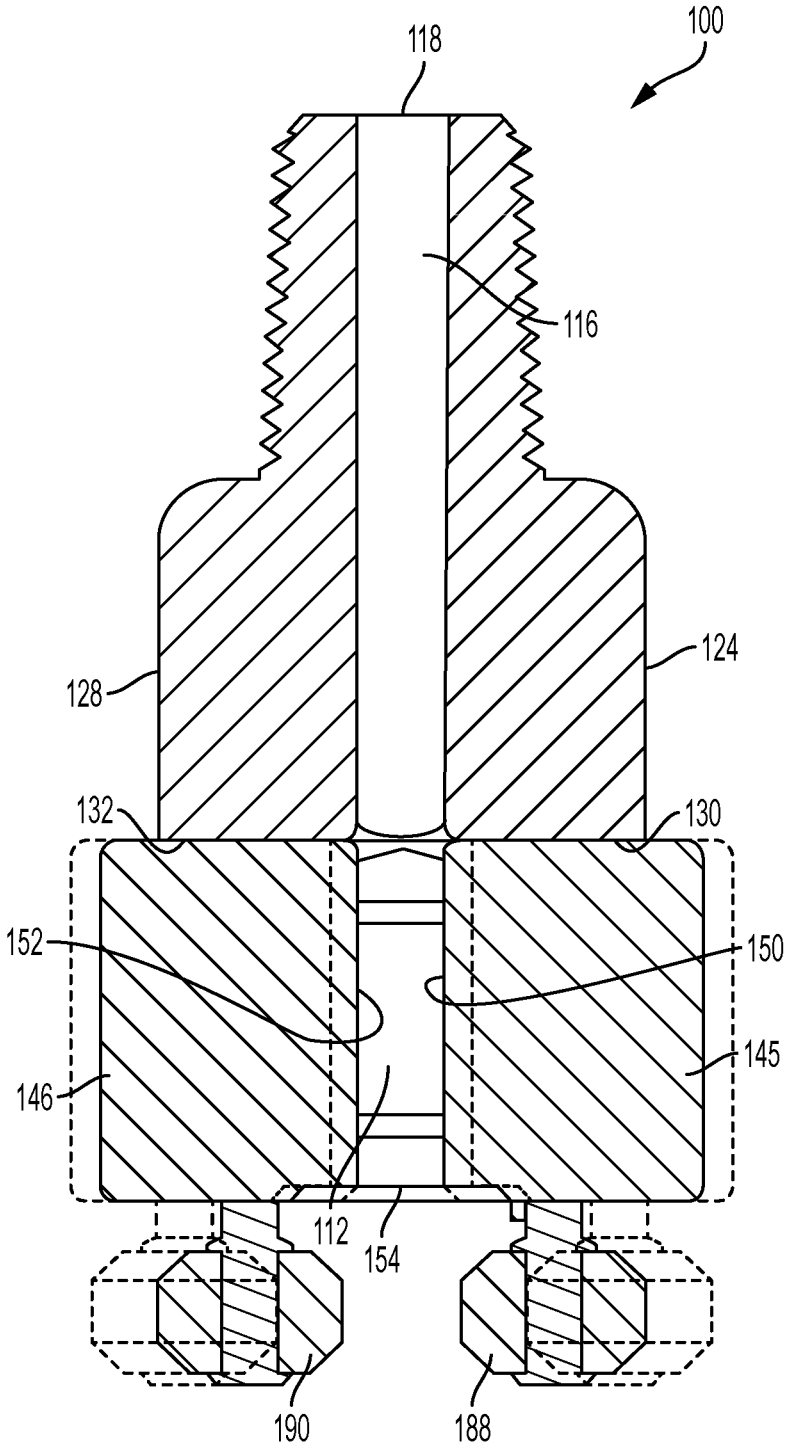
FIG. 5 is a sectional view of the illustrative apparatus of FIG. 3 taken along lines 5-5 in FIG. 3.
Figure 6:
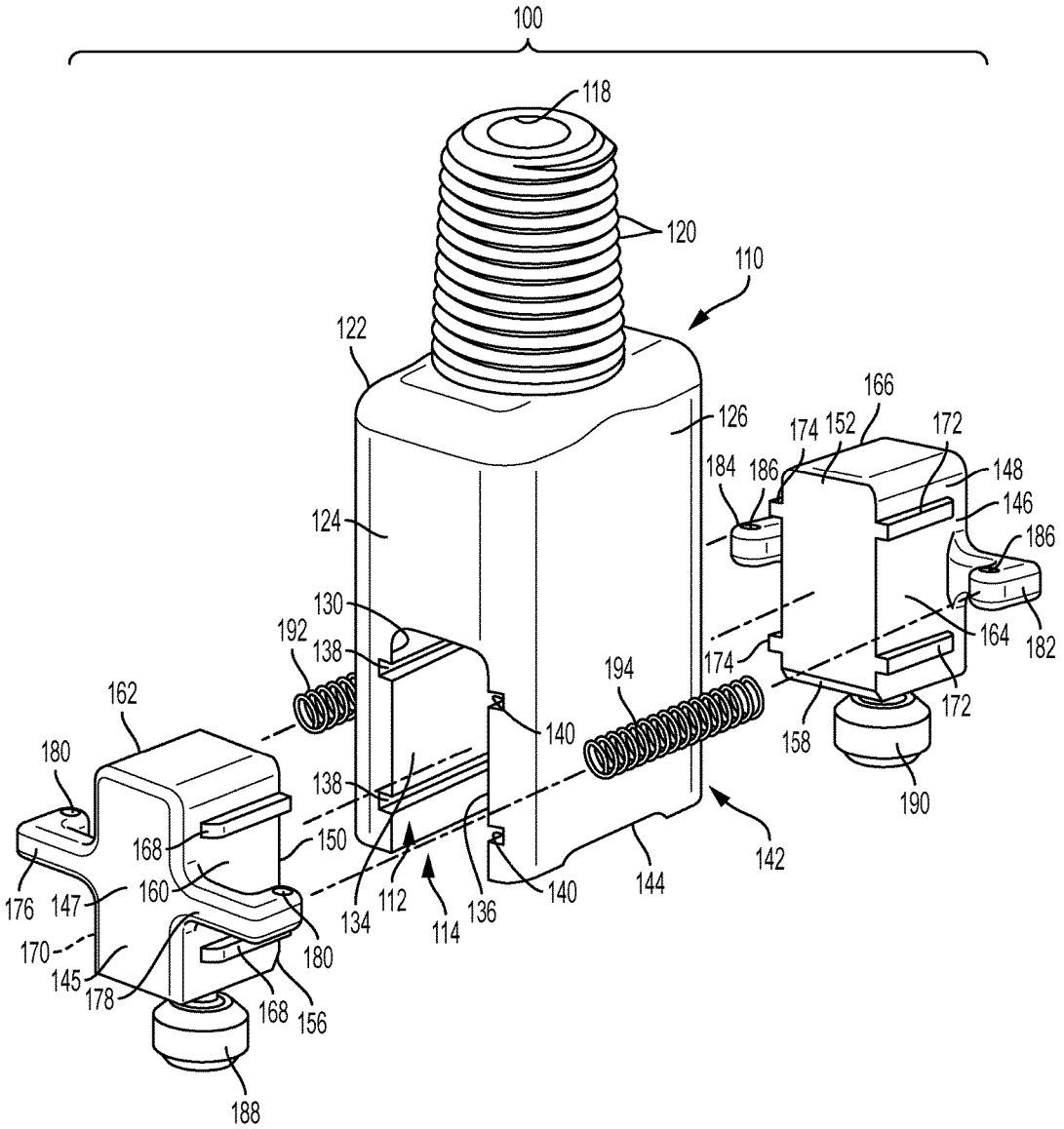
FIG. 6 is an exploded view of the illustrative apparatus of FIG. 3.

This example describes an illustrative viscous fluid application system 50 and an illustrative component 52; see FIG. 2.

Component 52 may include one or more features or properties of component 22 described above with reference to FIG. 1. For example, component 52 may include a primary surface 54 and opposed surfaces 56 and 58 that are perpendicular or substantially perpendicular to the primary surface.

Viscous fluid application system 50 may include a nozzle assembly 60, which may sometimes be referred to as an "adjustable nozzle." Nozzle assembly 60 may include any suitable structure configured to apply a viscous fluid to component 52. Nozzle assembly 60 may sometimes be referred to as an "adjustable nozzle." Nozzle assembly 60 may include a body 62. Body 62 may include a passage 64 for receiving and/or containing a viscous fluid. In some examples, passage 64 may include a bladder or chamber for containing a viscous fluid. Passage 64 may include an outlet or output opening 66 for discharging a viscous fluid from the passage to component 52, which may result in a bead 68 supported by and/or on component 52. In some examples, body 62 may include an inlet or input port 70 configured to receive a viscous fluid from any suitable source, such as a source that is external to viscous fluid application system 50. Input port 70 may be fluidly connected to passage 64.

Nozzle assembly 60 may include side members 72 and 74, which may be movably connected to body 62, such as slidably and/or pivotably connected to body 62. For example, side members 72 and 74 may include protruding members, while body 62 may have slots configured to slidably receive those protruding members, or vice-versa. Side members 72 and 74 may be at least partially received in passage 64. Additionally, side members 72 and 74 may be opposed to each other or in any suitable orientation to each other. When side members 72 and 74 are opposed to each other and movably connected to body 62, the side members may be configured to move toward each other and/or away from each other, as illustrated by arrows 75.

Nozzle assembly 60 may include one or more contact elements 76 attached to or formed with side members 72 and 74. Contact elements 76 may include any suitable structure configured to contact component 52, such as opposed surfaces 56 and 58, and/or to move across those surfaces. For example, contact elements 76 may include feet, rollers, wheels, etc. Contact elements 76 may be made of any suitable materials, such as materials that reduce friction and/or reduce or eliminate scratches or damage to component 52 (e.g., nylon, rubber, polytetrafluoroethylene, etc.).

Nozzle assembly 60 may include at least one biasing element 78 attached to side members 72 and 74. Biasing element 78 may include any suitable structure configured to urge the side members toward each other and/or away from each other. For example, biasing element 78 may include one or more coil springs, leaf springs, rubber bands, musical wire, etc. When biasing element 78 is configured to urge side members 72 and 74 toward each other, the biasing element may be configured to maintain contact elements 76 in contact with opposed surfaces 56 and 58.

Nozzle assembly 60 may include at least one position element 80 movably connected to body 62. Position element 80 may include any suitable structure configured to place outlet 66 at a suitable orientation (e.g., parallel to primary surface 54) and/or a suitable distance from component 52 to apply a viscous fluid on the component. For example, position element 80 may include feet, rollers, wheels, etc. Position element 80 may contact component 52, such as primary surface 54, and move along that component (e.g., along primary surface 54). When position element 80 includes roller, wheels, or other similar structures, the position element may be movably connected to body 62 and configured to roll or otherwise move on component 52, such as primary surface 54.

Viscous fluid application system 50 may include a robotic arm 82. Robotic arm 82 may include any suitable structure attached to nozzle assembly 60 and configured to move the nozzle assembly.

Viscous fluid application system 50 may include a controller assembly 84. Controller assembly 84 may include any suitable structure configured to direct and/or control the robotic arm. For example, controller assembly 84 may be configured to position nozzle assembly 60 adjacent to component 52, such as to maintain a suitable orientation and/or suitable distance between outlet 66 and primary surface 54. Controller assembly 84 may be configured to move nozzle assembly 60 along primary surface 54, such as when a viscous fluid is being applied. In some examples, controller assembly 84 may vary the speed of movement of the nozzle assembly based, for example, on the desired amount of viscous fluid applied to component 52, the desired aspect ratio for bead 68, and/or other factors. In some examples, controller assembly 84 may control the flow of a viscous fluid through nozzle assembly 60. For example, controller assembly 84 may control the flow of viscous fluid into nozzle assembly 60, such as when nozzle assembly 60 includes an input port 70.

Example 3

This example describes an illustrative nozzle assembly or apparatus 100 and an illustrative component 102; see FIGS. 3-6.

Component 102 may include one or more properties described above for component 22. For example, component 102 may include a primary surface 104 and opposed surfaces 106 and 108 that are perpendicular or substantially perpendicular to the primary surface.

Nozzle assembly 100 may include one or more different features similar to the features of nozzle assembly 60 described above with reference to FIG. 2. Nozzle assembly 100 may include a body 110. Body 110 may include any suitable structure configured to receive a viscous fluid. For example, body 110 may include a passage 112 for receiving and/or containing a viscous fluid. Passage 112 may include a body outlet 114 for discharging a viscous fluid on component 102. Body 110 may include an input conduit 116 for receiving a viscous fluid from a source external to body 110. Input conduit 116 may be fluidly connected to passage 112 and may include an inlet or input port 118. Body 110 may include a plurality of threads, nubbins, depressions, protuberances, and/or other connecting structures 120 for connecting, for example, a tube or pipe to input conduit 116.

Body 110 may include body walls 122, 124, 126, and 128. Body walls 122 and 126 may be opposed to each other and may at least partially define passage 112 therebetween. Body walls 124 and 128 may be opposed to each other and may include passage openings 130 and 132, respectively. Body wall 122 may include a passage surface 134, while body wall 126 may include a passage surface 136. Passage surface 134 may include at least one slot 138, while passage surface 136 may include at least one slot 140. Although passage surfaces 134 and 136 are shown to each include two slots, one or more of those passage surfaces may include one, three, four, or more slots.

Body wall 126 may include an end portion 142. End portion 142 may include an opening 144 configured to shape at least a portion of a bead of the viscous fluid, such as when body wall 126 passes over that bead when nozzle assembly is moved along component 102. Body wall 122 may sometimes be referred to as a "leading wall" because body wall 122 may be ahead of output opening 114 when nozzle assembly 100 is moved along component 102 while applying a viscous fluid to that component. In contrast, body wall 126 may sometimes be referred to as a "trailing wall" because body wall 126 may follow output opening 114 when nozzle assembly 100 is moved along component 102 while applying a viscous fluid to that component.

Nozzle assembly 100 may include side members 145 and 146. Side members 145 and 146 may include any suitable structure configured to be at least partially received in passage 112 and/or movably connected to body 110. In some examples, side members 145 and 146 may be configured to move toward each other and away from each other. Side members 145 and 146 may be opposed and/or in any suitable orientation relative to each other.

Side member 145 may include a base portion 147, while side member 146 may include a base portion 148. Base portions 147 and 148 may be configured to be slidably received in passage 112. Base portion 147 may include a passage wall 150, while base portion 148 may include a passage wall 152. Passage walls 150 and 152 and passage surfaces 134 and 136 may define an output opening 154 for viscous fluid in passage 112. Movement of side members 145 and 146 toward each other and away from each other moves passage walls 150 and 152 toward each other and away from each other, respectively. Movement of passage walls 150 and 152 toward each other and away each other may vary output opening 154. Passage walls 150 and 152 may be configured to guide a viscous fluid to any suitable portion(s) of component 102. For example, passage walls 150 and 152 may be configured to guide viscous fluid to only primary surface 104 or to only primary surface 104 and portion(s) of one or both opposed surfaces 106 and 108.

For example, movement of passage walls 150 and 152 toward each other decreases the area or size of output opening 154 to guide viscous fluid to primary surface 104 of a component 102 with a smaller width (e.g., distance between opposed surfaces 106 and 108) and/or guide the viscous fluid to only primary surface 104. In contrast, movement of passage walls 150 and 152 away from each other increases the area or size of output opening to guide viscous fluid to primary surface 104 of a component 102 with a larger width and/or guide the viscous fluid is to be applied to only primary surface 104 and portion(s) of one or both of opposed surfaces 106 and 108. For example, the size of output opening 154 may be adjusted responsive to variations in distance between opposed surfaces 106 and 108 as nozzle assembly 100 is moved along a path defined by primary surface 104.

Base portion 147 may include at least one shaping wall 156, while base portion 148 may include at least one shaping wall 158. Shaping walls 156 and 158 may be configured to shape at least a portion of a bead of a viscous fluid applied to component 102. Shaping walls 156 and 158 may have any suitable shape(s) to form and/or shape one or more portions of a bead of a viscous fluid applied to component 102.

Base portion 147 may include side walls 160 and 162, while base portion 148 may include side walls 164 and 166. Side wall 160 may include at least one protruding member 168, while side wall 162 may include at least one protruding member 170. Similarly, side wall 164 may include at least one protruding member 172, while side wall 166 may include at least one protruding member 174. Protruding members 168 and 172 may be configured to be slidably received in slot 140, while protruding members 170 and 174 may be configured to be slidably received in slot 138. Although the above side walls are shown to each include two protruding members, one or more of those sidewalls may include one, three, four, or more protruding members. Additionally, although the passage walls are shown to include slots and the above side walls are shown to include protruding members, one or more of the passage walls may include protruding members and one or more of the side walls may include slots.

Side member 145 may include wing portions 176 and 178, which may be attached to and/or formed with base portion 147. Wing portions 176 and 178 may be configured to be external passage 112 and/or body 110. Base portion 147 may be disposed in any suitable position relative to wing portions 176 and 178, such as between wing portions 176 and 178. Wing portions 176 and 178 may each include at least one aperture or opening 180. In some examples, wing portions 176 and 178 may be external passage 112 but internal body 110, such as through one or more passages in body 110.

Side member 146 may include wing portions 182 and 184, which may be attached to and/or formed with base portion 148. Wing portions 182 and 184 may be configured to be external passage 112. Base portion 148 may be disposed in any suitable position relative to wing portions 182 and 184, such as between wing portions 182 and 184. Wing portions 182 and 184 may each include at least one aperture or opening 186. In some examples, wing portions 182 and 184 may be external passage 112 but internal body 110, such as through one or more passages in body 110.

Nozzle assembly 100 may include side rollers 188 and 190. Side rollers 188 and 190 may be rotatably attached to side members 145 and 146, respectively. Side rollers 188 and 190 may be configured to contact opposed surfaces 106 and 108 and to roll on those surfaces as nozzle assembly 100 is moved along primary surface 104.

Nozzle assembly 100 may include springs 192 and 194. Spring 192 may be attached to wing portions 176 and 184 via openings 180 and 186, and may be configured to urge those portions toward each other. Spring 194 may be attached to wing portions 178 and 182 via openings 180 and 186, and may be configured to urge those portions toward each other. In some examples, springs 192 and/or 194 may be attached to base portions 147 and 148.

Example 4

Figure 7:
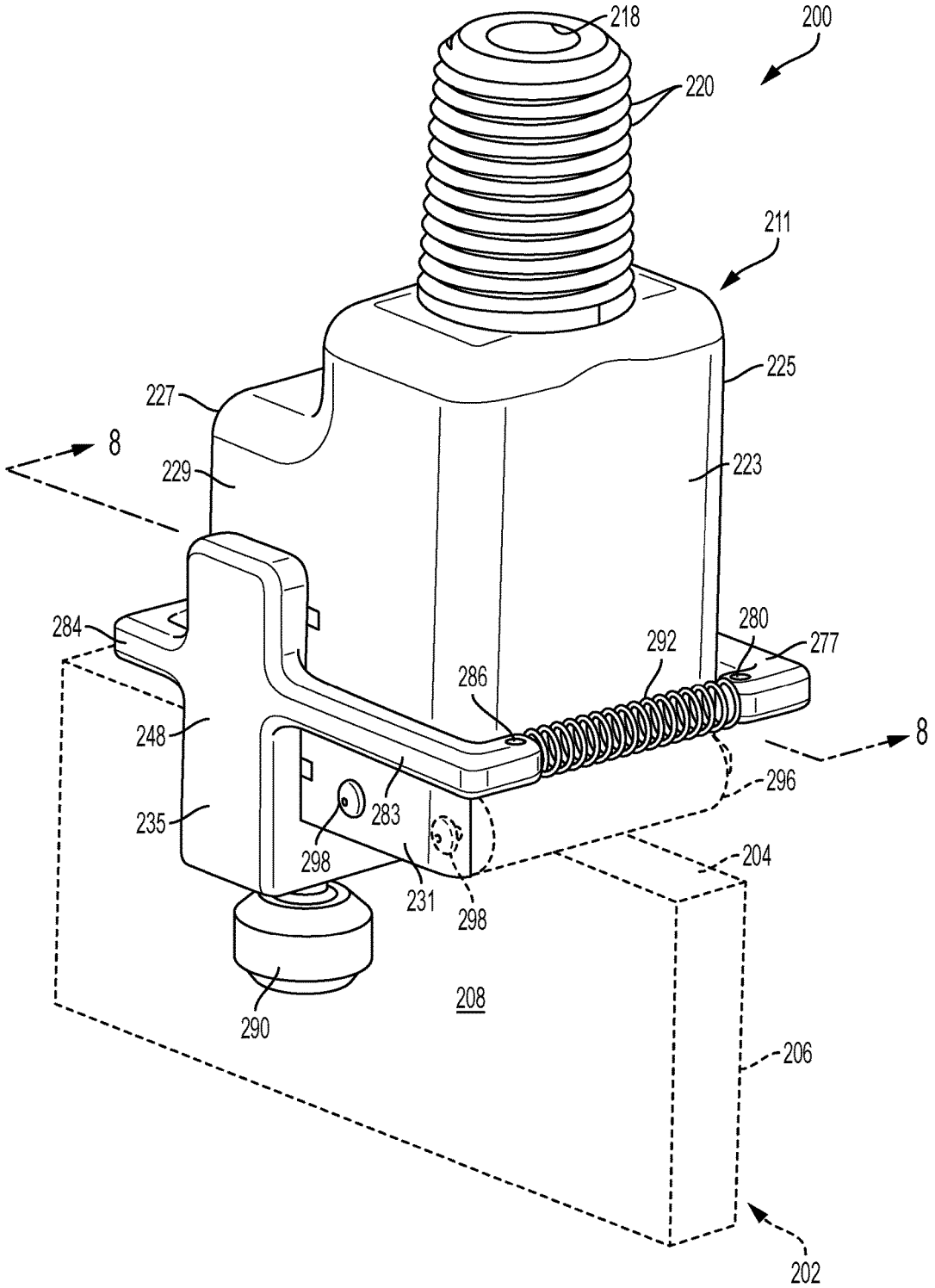
FIG. 7 is a perspective view of an illustrative apparatus and an illustrative component.
Figure 8:
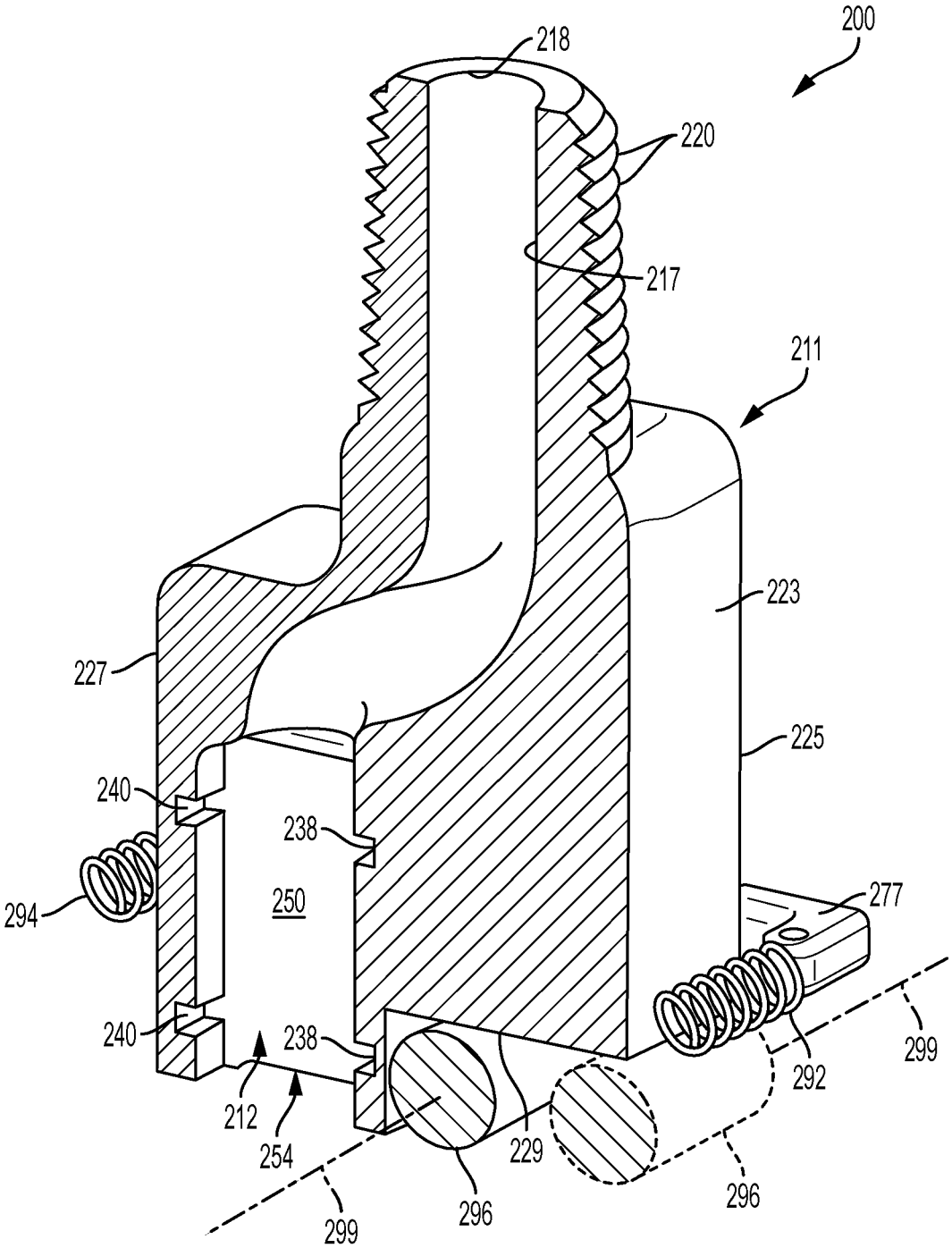
FIG. 8 is a sectional view of the illustrative apparatus of FIG. 7 taken along lines 8-8 in FIG. 7.
Figure 9:
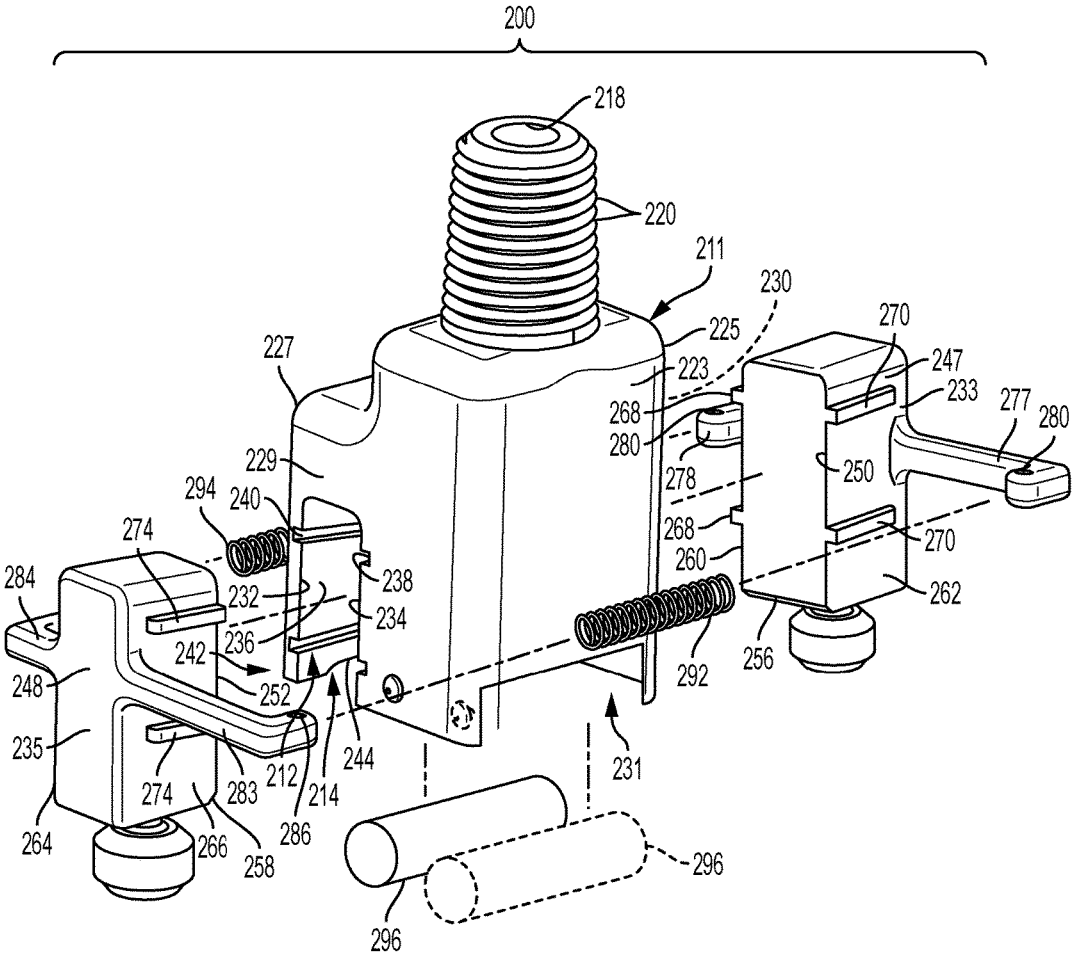
FIG. 9 is an exploded view of the illustrative apparatus of FIG. 7.

This example describes an illustrative nozzle assembly or apparatus 200 and an illustrative component 202; see FIGS. 7-9.

Component 202 may include one or more properties described above for component 22. For example, component 202 may include a primary surface 204 and opposed surfaces 206 and 208 perpendicular or substantially perpendicular to the primary surface.

Nozzle assembly 200 is similar in many respects to nozzle assembly 100 described in Example 3, but with a different-shaped body, different wing portions, and additional contact element(s), as further described below. Components or parts of nozzle assembly 200 correspond to components or parts of nozzle assembly 100, and are labeled with similar reference numbers having the general form "2XX" rather than "1XX." Accordingly, features 212, 214, 218, 220, 230, 232, 234, 236, 238, 240, 242, 244, 247, 248, 250, 252, 254, 256, 258, 260, 262, 264, 266, 268, 270, 272, 274, 278, 280, 284, 286, 288, 290, 292, and 294 may be identical or substantially identical to their respective counterparts in Example 3, namely features 112, 114, 118, 120, 130, 132, 134, 136, 138, 140, 142, 144, 147, 148, 150, 152, 154, 156, 158, 160, 162, 164, 166, 168, 170, 172, 174, 178, 180, 184, 186, 188, 190, 192, and 194.

Nozzle assembly 200 may include a body 211. Body 211 may include a passage 212 for receiving a viscous fluid. Passage 212 may include a body outlet 214 for discharging a viscous fluid on component 202. Body 211 may include an input conduit 217 for receiving a viscous fluid from a source external to body 211. Input conduit 217 may be fluidly connected to passage 212 and may include an inlet or input port 218. Input conduit 217 may be curvilinear to fluidly connect to passage 212. Body 211 may include a plurality of threads, nubbins, depressions, protuberances, and/or other connecting structures 220 for connecting, for example, a tube or pipe to input conduit 217.

Body 211 may include body walls 223, 225, 227, and 229. Body walls 223 and 227 may be opposed to each other and may at least partially define passage 212 and a receiving portion 231 therebetween. Passage 212 may be closer to body wall 227 than body wall 223, while receiving portion 231 may be closer to body wall 223 than body wall 227. In other words, passage 212 may be adjacent to body wall 227 and spaced from body wall 223 relative to body wall 227, while receiving portion 231 may be adjacent to body wall 223 and spaced from body wall 227 relative to body wall 223. Body walls 225 and 229 may be opposed to each other and may include passage openings 230 and 232, respectively. Receiving portion 231 may be configured to receive one or more contact elements, as further discussed below.

Nozzle assembly 200 may include side members 233 and 235, which may include any suitable structure configured to be at least partially received in passage 212 and/or movably connected to body 211. In some examples, side members 233 and 235 may be configured to move toward each other and away from each other. Side members 233 and 235 may be opposed and/or in any suitable orientation relative to each other.

Side member 233 may include a base portion 247 and wing portions 277 and 278, while side member 235 may include a base portion 248 and wing portions 283 and 284. Wing portions 277, 278, 283, and 284 may be configured to be external passage 212 and/or body 211. Base portion 247 may be disposed in any suitable position relative to wing portions 277 and 278, such as between wing portions 277 and 278. Wing portions 277 and 278 may each include at least one aperture or opening 280. Base portion 248 may be disposed in any suitable position relative to wing portions 283 and 284, such as between wing portions 283 and 284. Wing portions 283 and 284 may each include at least one aperture or opening 286. Wing portions 277 and 283 may be longer than wing portions 278 and 284, such as to extend beyond receiving portion 231 of body 211. In some examples, one or more wing portions 277, 278, 283, and 284 may be external passage 212 but internal body 211, such as through one or more passages other than passage 212.

Nozzle assembly 200 may include one or more body contact elements 296, such as one or more rollers. Roller(s) 296 may be rotatably connected (such as via fasteners 298) to receiving portion 231 of body 211. Body roller 296 may have any suitable orientation relative to body 211. For example, body roller 296 may have a rotation axis 299 that is perpendicular to body walls 223, 225, 227, and/or 229. Body roller 296 may be configured to place output opening 254 at a suitable orientation (e.g., parallel to primary surface 204) and/or at a suitable distance to discharge a viscous fluid on component 202. For example, body roller 296 may contact primary surface 204 and to roll on the primary surface when nozzle assembly 200 is moved along that surface. Nozzle assembly 200 may have any suitable number of body rollers 296, including one, two, three, four, or more body rollers 296. In some examples, body contact elements may include body feet, body wheels, or other structure configured to contact primary surface 204 and to be moved along that surface.

Example 5

Figure 10:
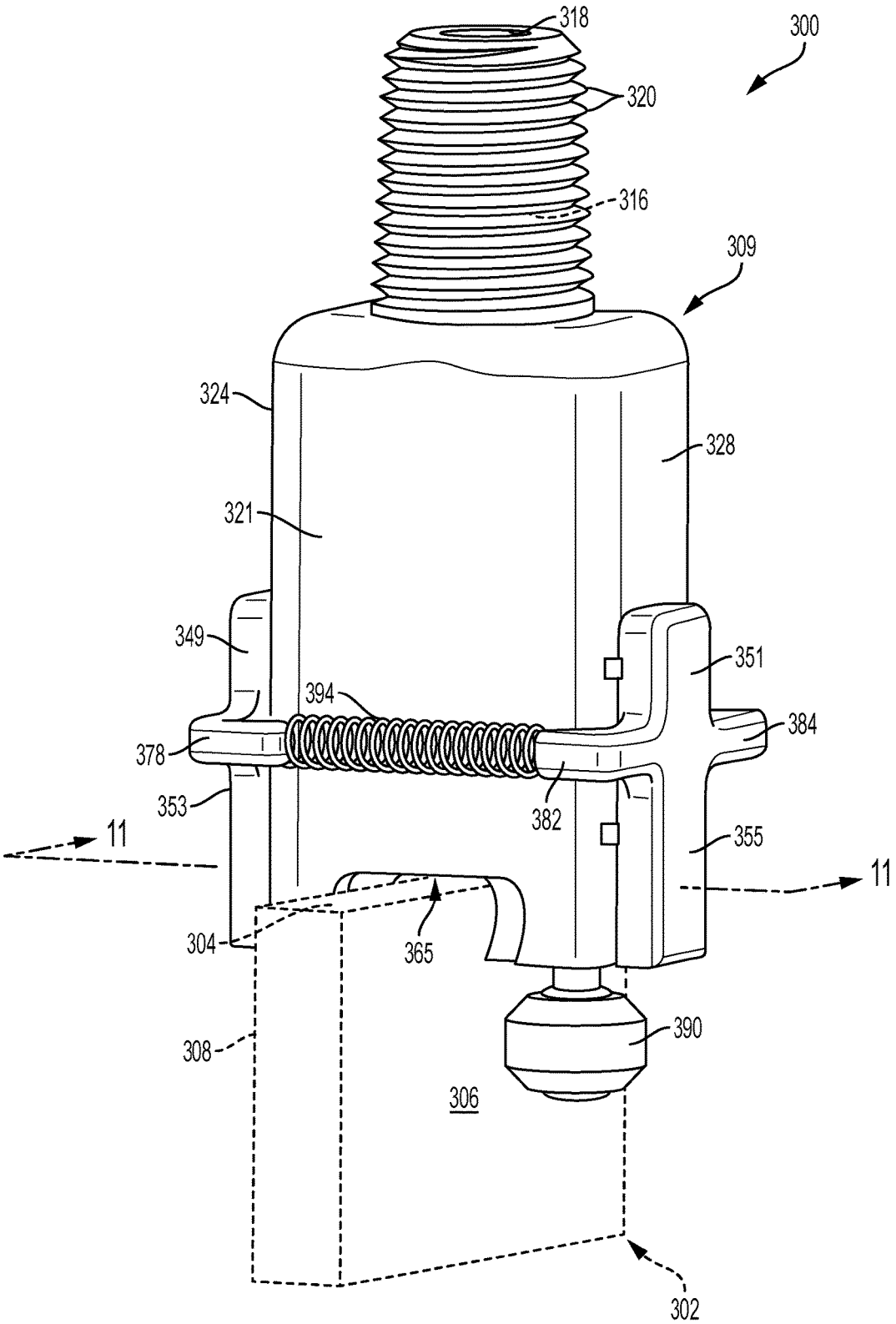
FIG. 10 is a perspective view of an illustrative apparatus and an illustrative component.
Figure 11:
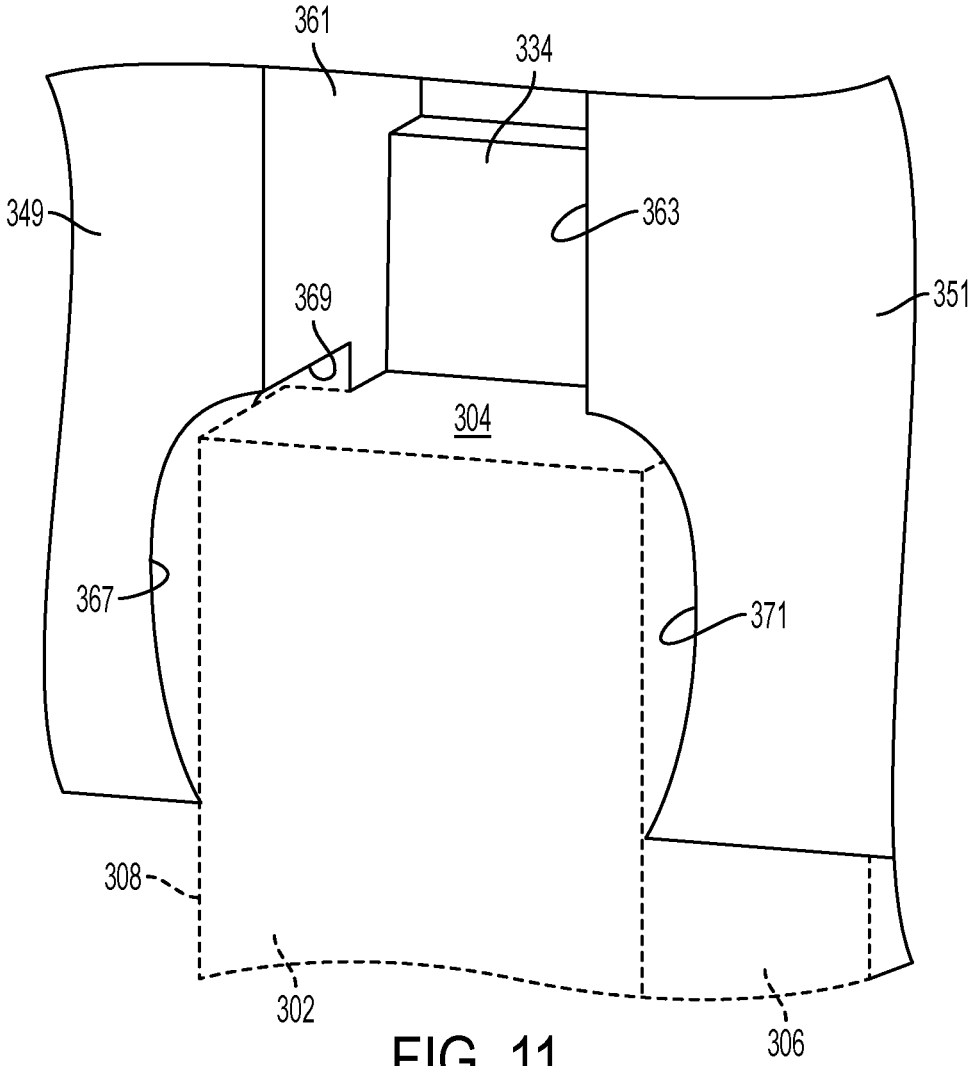
FIG. 11 is a partial view of the illustrative apparatus of FIG. 10.
Figure 12:
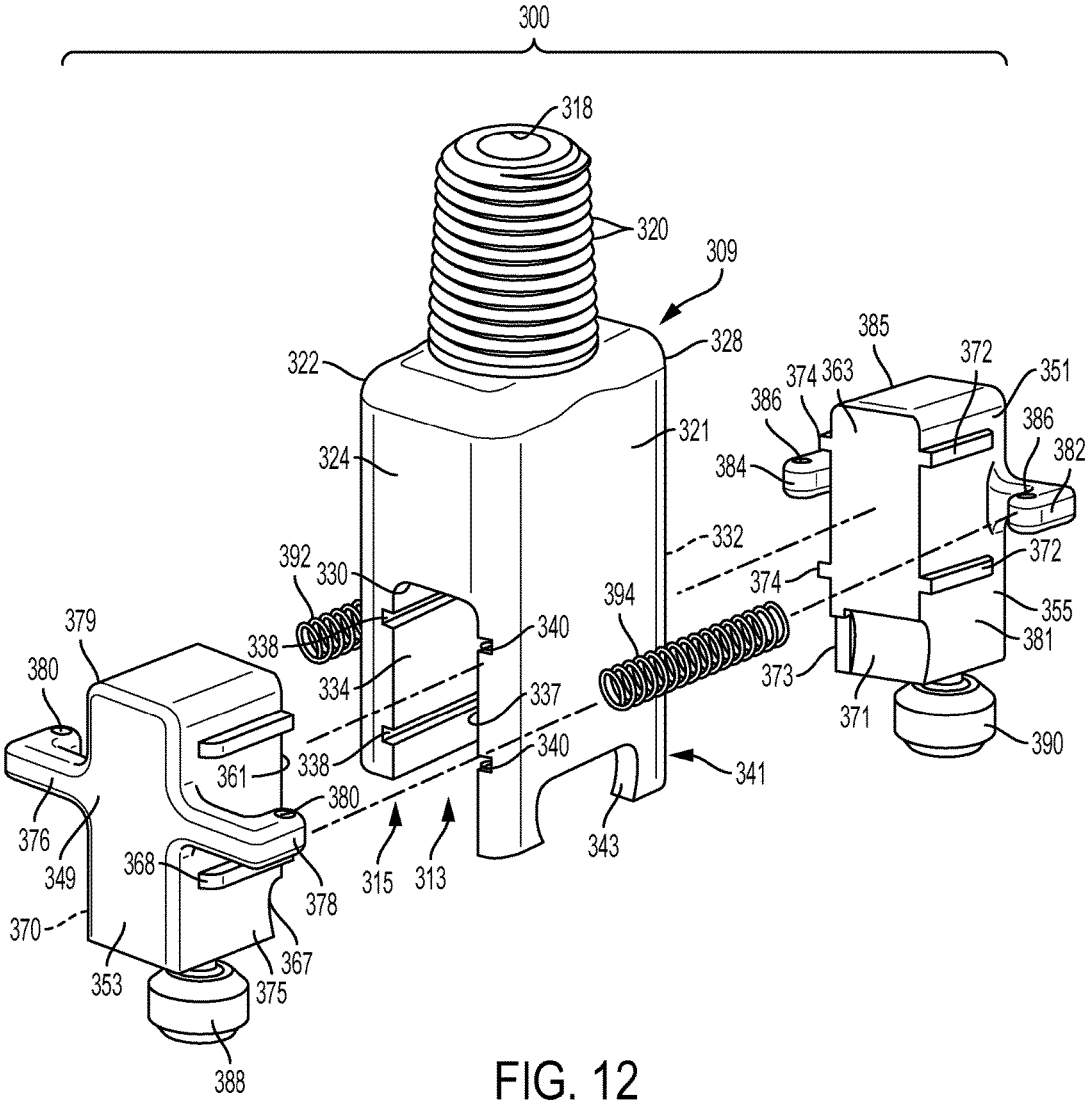
FIG. 12 is an exploded view of the illustrative apparatus of FIG. 10.

This example describes an illustrative nozzle assembly or apparatus 300 and an illustrative component 302; see FIGS. 10-12.

Component 302 may include one or more properties described above for component 22. For example, component 302 may include a primary surface 304 and opposed surfaces 306 and 308 perpendicular or substantially perpendicular to the primary surface.

Nozzle assembly 300 is similar in many respects to nozzle assembly 100 described in Example 3, but with a different body wall and different side members, as further described below. Components or parts of nozzle assembly 300 correspond to components or parts of nozzle assembly 100, and are labeled with similar reference numbers having the general form "3XX" rather than "1XX." Accordingly, features 316, 318, 320, 324, 328, 330, 332, 334, 338, 340, 368, 370, 372, 374, 376, 378, 380, 382, 384, 386, 388, 392, and 394 may be identical or substantially identical to their respective counterparts in Example 3, namely features 116, 118, 120, 124, 128, 130, 132, 134, 138, 140, 168, 170, 172, 174, 176, 178, 180, 182, 184, 186, 188, 192, and 194.

Nozzle assembly 300 may include a body 309. Body 309 may include body walls 321, 322, 324, and 328. Body wall 321 may be configured to extend below the plane of primary surface 304 when nozzle assembly 300 is placed in a position to apply viscous fluid to that surface. Body wall 321 may include a passage surface 337 and an end portion 341. End portion 341 may include an opening 343 sized to accommodate a width of component 302, such as the distance between opposed surfaces 306 and 308. Additionally, opening 343 may be configured to shape at least a portion of a bead of the viscous fluid, such as when body wall 321 passes over that bead when nozzle assembly is moved along component 302.

Nozzle assembly 300 may include side members 349 and 351, which may include base portions 353 and 355, respectively. Base portions 353 and 355 may extend below body wall 322. In other words, base portions 353 and 355 may be configured to extend below primary surface 304 (such as a plane of primary surface 304) when nozzle assembly 300 is in a position to apply viscous fluid to that surface.

Base portion 353 may include at least one shaping wall 367 and at least one containment wall 369, while base portion 355 may include at least one shaping wall 371 and at least one containment wall 373. Shaping walls 367 and 371 may be configured to shape at least a portion of a bead of a viscous fluid applied to component 302. Shaping walls 367 and 371 may have any suitable shape(s) to form and/or shape one or more portions of a bead of a viscous fluid applied to component 302, such as any suitable curvilinear and/or rectilinear shapes. Shaping walls 367 and 371 may extend below body wall 322. In other words, shaping walls 367 and 371 may extend below primary surface 304 (such as a plane of primary surface 304) when nozzle assembly 300 is applying viscous fluid to component 302, such as when viscous fluid is applied to only primary surface 304 and a portion of opposed surfaces 306 and 308. Shaping walls 367 and 371 may have different dimensions relative to each other, such as different lengths, widths, and/or heights. For example, a portion of a bead formed on opposed surface 306 may be larger than another portion of the bead formed on opposed surface 308, or vice-versa.

Containment walls 369 and 373 may be configured to contain viscous fluid within output opening 365 and/or to prevent or reduce flow of viscous fluid toward body wall 322. Containment walls 369 and 373 may have any suitable shape(s) to contain viscous fluid within an output opening 365. For example, containment walls 369 and 373 may be planar walls that are recessed relative to passage walls 361 and 363.

Example 6

Figure 13:
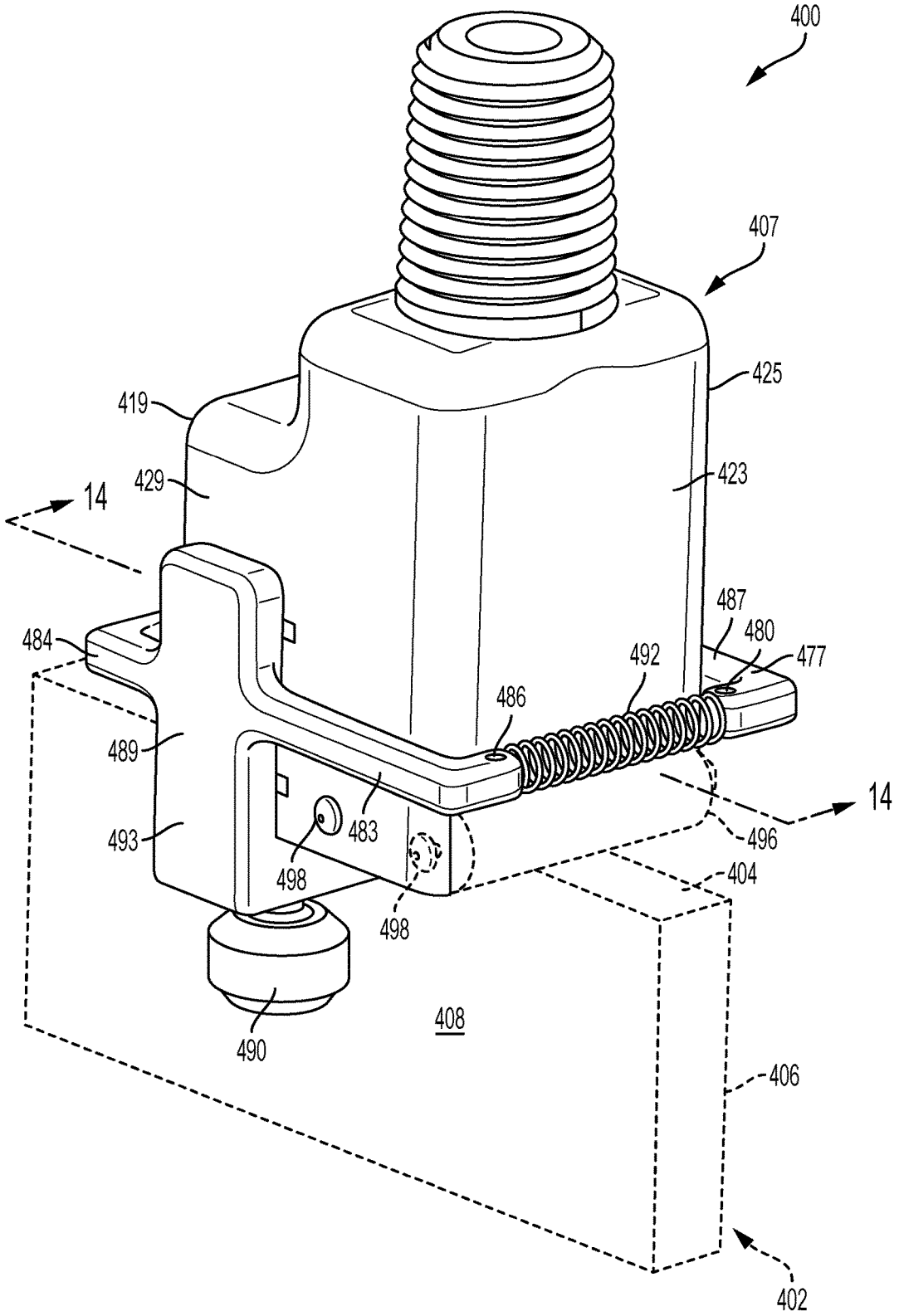
FIG. 13 is a perspective view of an illustrative apparatus and an illustrative component.
Figure 14:
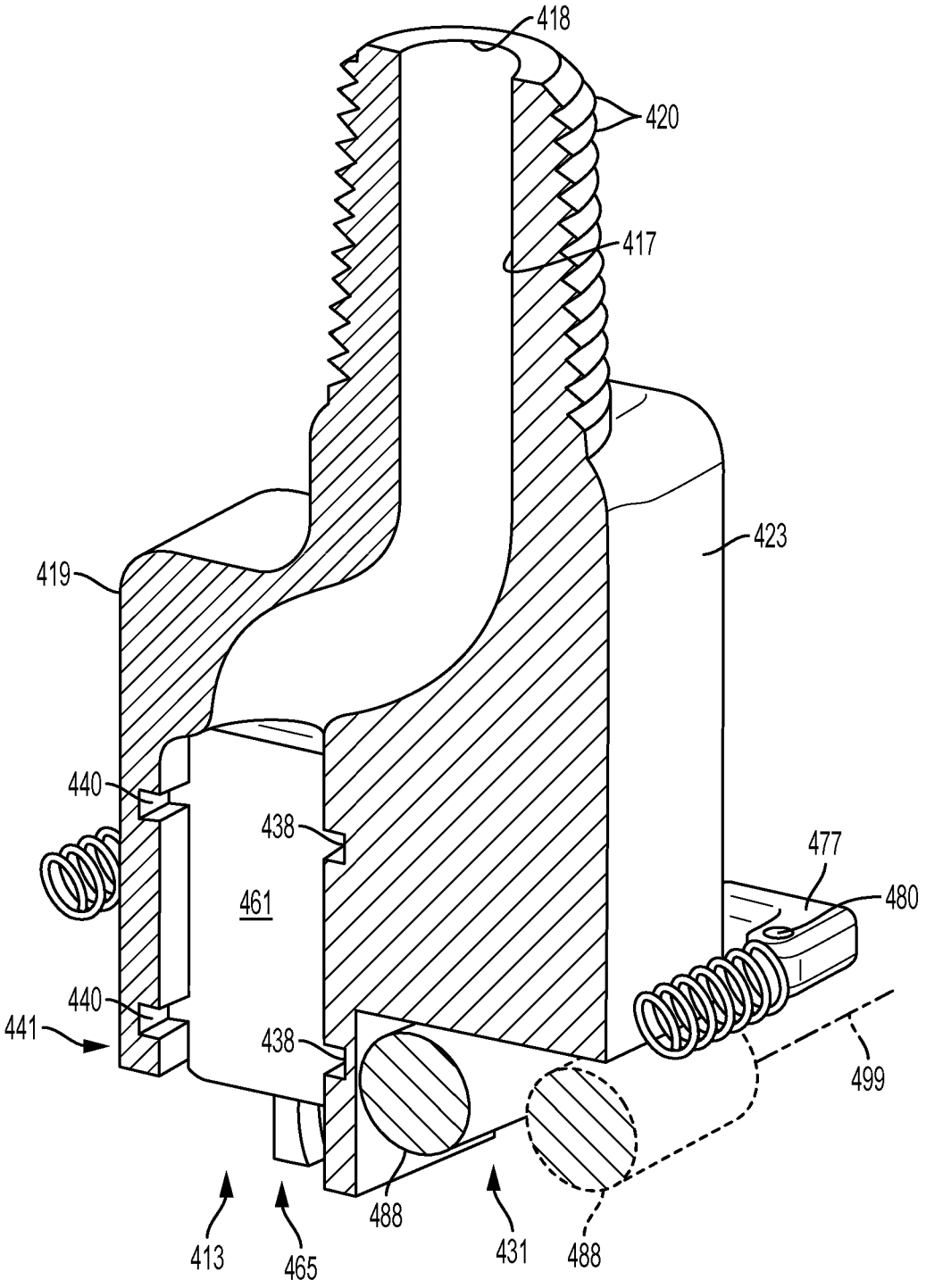
FIG. 14 is a sectional view of an illustrative apparatus taken along lines 14-14 in FIG. 13.
Figure 15:
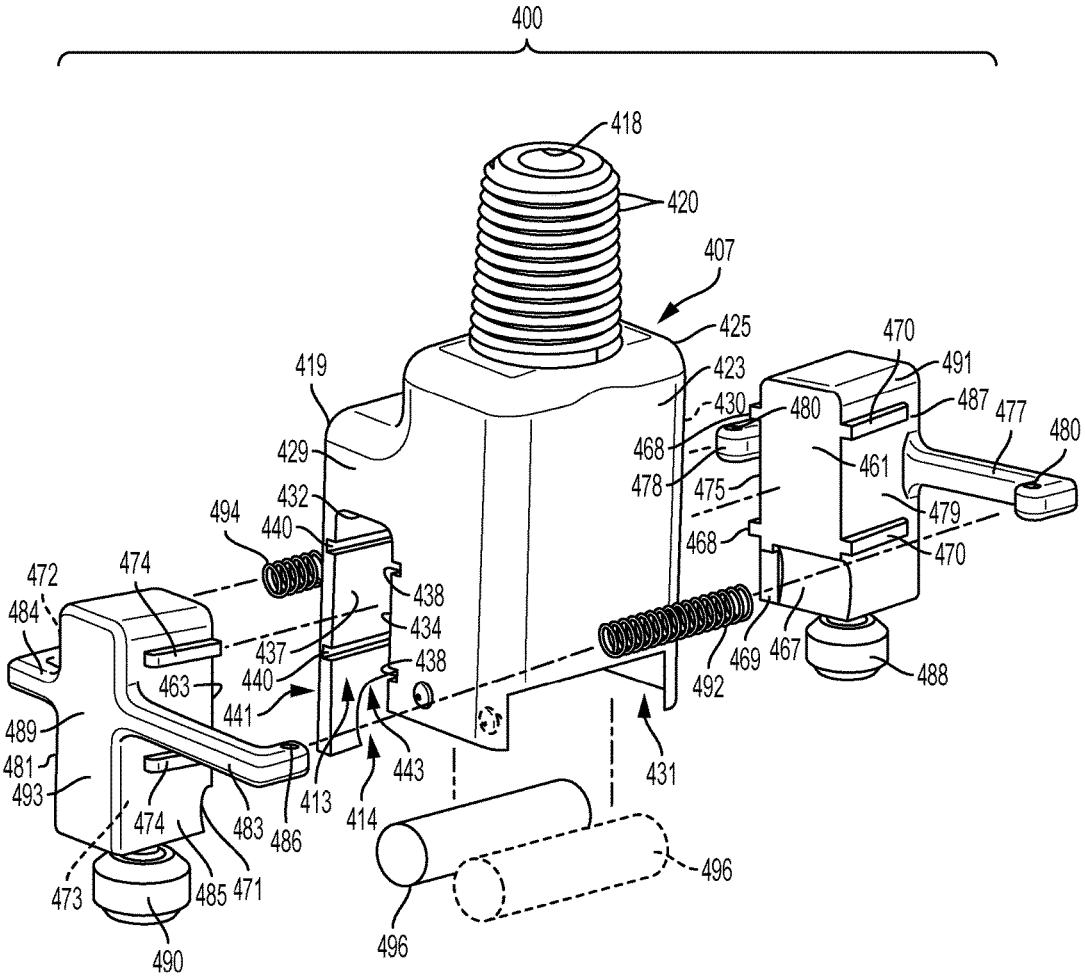
FIG. 15 is an exploded view of the illustrative apparatus of FIG. 13.

This example describes an illustrative nozzle assembly or apparatus 400 and an illustrative component 402; see FIGS. 13-15.

Component 402 may include one or more properties described above for component 22. For example, component 402 may include a primary surface 404 and opposed surfaces 406 and 408 perpendicular or substantially perpendicular to the primary surface.

Nozzle assembly 400 is similar in many respects to nozzle assembly 300 described in Example 5, but with a different-shaped body, different wing portions, and additional contact element(s), as further described below. Components or parts of nozzle assembly 400 correspond to components or parts of nozzle assembly 300, and are labeled with similar reference numbers having the general form "4XX" rather than "3XX." Accordingly, features 413, 418, 420, 430, 432, 434, 437, 438, 440, 441, 443, 461, 463, 465, 467, 468, 469, 470, 471, 472, 473, 474, 475, 478, 480, 484, 485, 486, 488, 490, 492, and 494 may be identical or substantially identical to their respective counterparts in Example 3, namely features 313, 318, 320, 330, 332, 334, 337, 338, 340, 341, 343, 361, 363, 365, 367, 368, 369, 370, 371, 372, 373, 374, 375, 378, 380, 384, 385, 386, 388, 390, 392, and 394.

Nozzle assembly 400 may include a body 407. Body 407 may include a passage 413 for receiving a viscous fluid. Passage 413 may include a body outlet 414 for discharging a viscous fluid on component 402. Body 407 may include an input conduit 417 for receiving a viscous fluid from a source external to body 407. Input conduit 417 may be fluidly connected to passage 413 and may include an inlet or input port 418. Input conduit 417 may be curvilinear to fluidly connect to passage 413. Body 407 may include a plurality of threads, nubbins, depressions, protuberances, and/or other connecting structures 420 for connecting, for example, a tube or pipe to input conduit 417.

Body 407 may include body walls 419, 423, 425, and 429. Body walls 419 and 423 may be opposed to each other and may at least partially define passage 413 and a receiving portion 431 therebetween. Passage 413 may be closer to body wall 419 than body wall 423, while receiving portion 431 may be closer to body wall 423 than body wall 419. In other words, passage 413 may be adjacent to body wall 419 and spaced from body wall 423 relative to body wall 419, while receiving portion 431 may be adjacent to body wall 423 and spaced from body wall 419 relative to body wall 423. Body walls 425 and 429 may be opposed to each other and may include passage openings 430 and 432, respectively. Receiving portion 431 may be configured to receive one or more contact elements, as further discussed below.

Nozzle assembly 400 may include side members 487 and 489, which may include any suitable structure configured to be at least partially received in passage 413 and/or movably connected to body 407. In some examples, side members 487 and 489 may be configured to move toward each other and away from each other. Side members 487 and 489 may be opposed and/or in any suitable orientation relative to each other.

Side member 487 may include a base portion 491 and wing portions 477 and 478, while side member 489 may include a base portion 493 and wing portions 483 and 484. Wing portions 477, 478, 483, and 484 may be configured to be external passage 413 and/or body 407. Base portion 491 may be disposed in any suitable position relative to wing portions 477 and 478, such as between wing portions 477 and 478. Wing portions 477 and 478 may each include at least one aperture or opening 480. Base portion 493 may be disposed in any suitable position relative to wing portions 483 and 484, such as between wing portions 483 and 484. Wing portions 483 and 484 may each include at least one aperture or opening 486. Wing portions 477 and 483 may be longer than wing portions 478 and 484, such as to extend around and/or or beyond body 407.

Nozzle assembly 400 may include one or more body contact elements 496, such as body rollers. Body rollers 496 may be rotatably connected (such as via fasteners 498) to receiving portion 431 of body 407. Body roller 496 may have any suitable orientation relative to body 407. For example, body roller 496 may have a rotation axis 499 that is perpendicular to body walls 419, 423, 425, and 429. Body roller 496 may be configured to place output opening 465 at a suitable distance to discharge a viscous fluid on component 402. For example, body roller 496 may contact primary surface 404 and to roll on the primary surface when nozzle assembly 400 is moved along that surface. Nozzle assembly 400 may have any suitable number of body rollers 496, including one, two, three, four, or more body rollers 496. In some examples, body contact elements 496 may include feet, wheels, or other structures configured to contact primary surface 404 and to be moved along that surface.

Example 7

Figure 16:
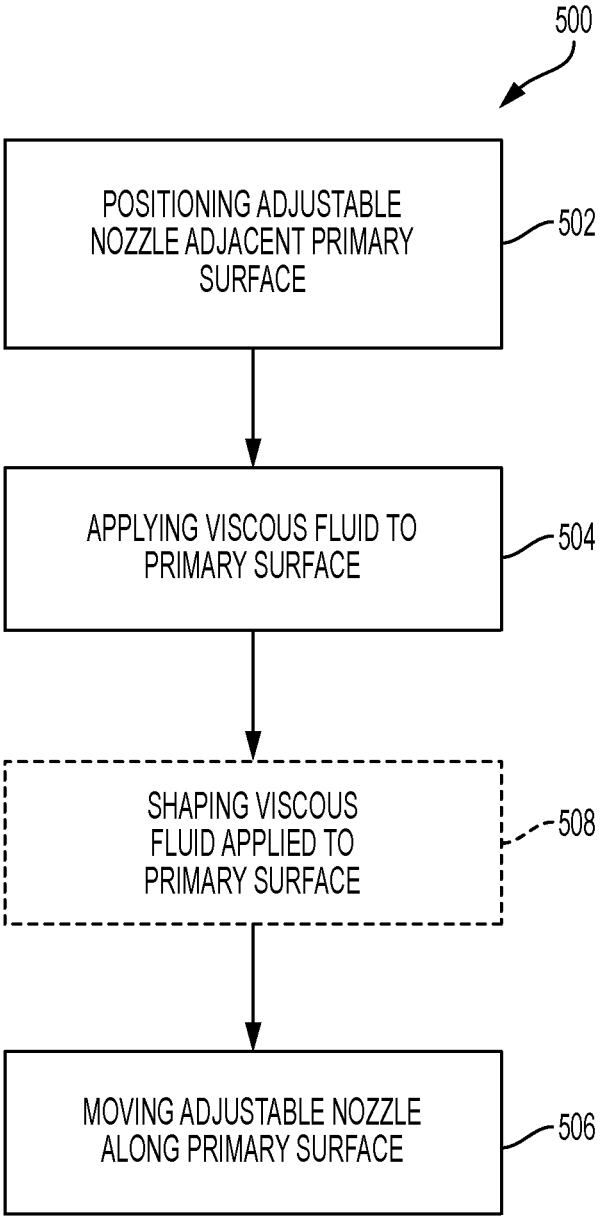
FIG. 16 is a flowchart illustrating a method for applying a viscous fluid to a component.

This example describes a method of applying a viscous fluid to a component having a primary surface and opposed surfaces perpendicular to the primary surface; see FIG. 16.

FIG. 16 depicts multiple steps of a method, generally indicated at 500, which may be performed in conjunction with any of the above viscous fluid application systems and/or nozzle assemblies according to aspects of the present disclosure. Although various steps of method 500 are described below and depicted in FIG. 16, the steps need not necessarily all be performed, and in some cases may be performed in a different order than the order shown.

Method 500 may include a step 502 of positioning an adjustable nozzle (such as one of the nozzle assemblies described in the present disclosure) adjacent a primary surface of a component. Positioning the adjustable nozzle may include positioning that nozzle such that first and second contact members of the nozzle, movable relative to each other, contact opposed surfaces of the component. The first and second contact members may be urged toward the opposed surfaces by at least one bias element of the adjustable nozzle, which may allow the first and second contact members to maintain contact with the opposed surfaces when the adjustable nozzle is moved along the component, such as along the primary surface. In some examples, positioning the adjustable nozzle may include placing at least one roller of the adjustable nozzle on the primary surface such that, for example, the roller rolls on the primary surface when the adjustable nozzle is moved along the primary surface.

Method 500 may include a step 504 of applying a viscous fluid from a passage in a body of the adjustable nozzle to the primary surface. The viscous fluid may be contained in the passage and/or may be received through an input port of the adjustable nozzle, such as from an external viscous fluid source. In some examples, applying a viscous fluid may include modifying a viscous fluid output opening of the adjustable nozzle based on a distance between the opposed surfaces. In some examples, viscous fluid may be applied to the primary surface and a portion of one or both of the opposed surfaces.

Method 500 may include a step 506 of moving the adjustable nozzle along the primary surface (e.g., along a path defined by the primary surface), such as while applying the viscous fluid to the primary surface and/or portion of the opposed surfaces. In some examples, the adjustable nozzle may be moved along the primary surface with a robotic arm, such as after coupling the adjustable nozzle to the robotic arm.

In some examples, method 500 may include a step 508 of shaping the viscous fluid applied to the primary surface, to a portion of the opposed surfaces, or to both with one or more shaping walls of the adjustable nozzle. The viscous fluid may be shaped by the shaping walls to any suitable shape(s), such as various convex and/or concave shapes.

Example 8

This section describes additional aspects and features of systems, apparatuses, and methods for viscous fluid application, which may or may not be claimed, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing without limitation examples of some of the suitable combinations.

A0. An adjustable nozzle for applying viscous fluid to a component having a primary surface and opposed surfaces perpendicular to the primary surface, the adjustable nozzle comprising:

a body having a passage for receiving a viscous fluid;

first and second opposed side members at least partially received in the passage and movably connected to the body;

a first contact element attached to the first side member;

a second contact element attached to the second side member; and at least one biasing element attached to the side members and configured to urge the side members toward each other.

A1. The adjustable nozzle of paragraph A0, wherein the first side member comprises a first shaping wall, the second side member comprises a second shaping wall, and the first shaping wall and the second shaping wall are configured to shape at least a portion of a bead of the viscous fluid applied to the component.

A2. The adjustable nozzle of any of paragraphs A0-A1, wherein the first side member includes a first passage wall, the second side member includes a second passage wall, and the first passage wall and the second passage wall are configured to guide the viscous fluid to only the primary surface.

A3. The adjustable nozzle of any of paragraphs A0-A1, wherein the first side member comprises a first passage wall, the second side member comprises a second passage wall, and the first passage wall and the second passage wall are configured to guide the viscous fluid to only the primary surface and a portion of the opposed surfaces.

A4. The adjustable nozzle of any of paragraphs A0-A3, wherein the body includes first and second opposed body walls at least partially defining the passage therebetween, one of the body walls including an opening configured to shape at least a portion of a bead of the viscous fluid.

A5. The adjustable nozzle of any of paragraphs A0-A4, wherein the body includes first and second opposed body walls at least partially defining the passage therebetween, the first and second body walls comprise one of at least one slot or at least one protruding member, the side members comprise another one of the at least one slot or the at least one protruding member, and the at least one protruding member is configured to be slidably received in the at least one slot.

A6. The adjustable nozzle of any of paragraphs A0-A5, wherein the at least one contact element is at least one roller.

A7. The adjustable nozzle of any of paragraphs A0-A6, wherein the body comprises an input port for the viscous fluid, and the passage is fluidly connected to the input port.

A8. The adjustable nozzle of any of paragraphs A0-A7, wherein the body comprises first and second opposed body walls at least partially defining the passage therebetween, the nozzle further comprises a roller attached to the body, and the roller has a rotation axis that is perpendicular to the first and second body walls.

A9. The adjustable nozzle of any of paragraphs A0-A8, wherein each of the side members includes first and second wing portions and a base portion disposed between the first and second wing portions, the base portion is configured to be slidably received in the passage, and the first and second wing portions are configured to be outside the passage.

A10. The adjustable nozzle of any of paragraphs A0-A9, wherein the at least one biasing element includes first and second springs, respective ones of the first and second springs attached to respective ones of the first and second wing portions.

B0. A method of applying a viscous fluid to a component having a primary surface and opposed surfaces perpendicular to the primary surface, the method comprising:

positioning an adjustable nozzle adjacent the primary surface such that first and second contact members of the nozzle, movable relative to each other, contact the opposed surfaces, the first and second contact members being urged toward the opposed surfaces by at least one biasing element of the adjustable nozzle;

applying a viscous fluid from a passage in a body of the adjustable nozzle to the primary surface; and moving the adjustable nozzle along the primary surface.

B1. The method of paragraph B0, wherein applying a viscous fluid includes modifying a viscous fluid output opening of the adjustable nozzle responsive to variations in distance between the opposed surfaces of the component along a path defined by the primary surface of the component.

B2. The method of any of paragraphs B0-B1, wherein applying a viscous fluid comprises applying the viscous fluid from the passage in the body of the adjustable nozzle to a portion of the opposed surfaces.

B3. The method of any of paragraphs B0-B2, further comprising shaping the viscous fluid applied to the primary surface, to a portion of the opposed surfaces, or to both with one or more shaping walls of the adjustable nozzle.

B4. The method of any of paragraphs B0-B3, further comprising receiving viscous fluid through an input port of the adjustable nozzle.

B5. The method of any of paragraphs B0-B4, wherein positioning the adjustable nozzle comprises placing a roller of the adjustable nozzle on the primary surface such that the roller rolls on the primary surface when the adjustable nozzle is moved along the primary surface.

B6. The method of any of paragraphs B0-B5, further comprising coupling the adjustable nozzle to a robotic arm, wherein moving the adjustable nozzle along the primary surface includes moving the nozzle with the robotic arm.

C1. A system for applying a viscous fluid to a component having a primary surface and opposed surfaces perpendicular to the primary surface, comprising:

- a robotic arm;
- a controller assembly configured to control the robotic arm; and
- an adjustable nozzle attached to the robotic arm, the adjustable nozzle comprising:
  - a body including a passage for receiving viscous fluid and having an output opening for discharging the viscous fluid on the component;
  - first and second opposed side members at least partially received in the passage and movably connected to the body;
  - a first contact element attached to the first side member;
  - a second contact element attached to the second side member; and
  - at least one biasing element attached to the side members and configured to urge the side members toward each other, wherein the side members are configured to adjust a size of the output opening responsive to variations in distance between the opposed surfaces of the component along a path defined by the primary surface of the component.

C1. The system of paragraph C0, wherein the controller assembly is configured to move the nozzle along the primary surface via the robotic arm.

D0. An adjustable nozzle for applying fluid to a component having a primary surface and opposed surfaces that are generally perpendicular to the primary surface, the adjustable nozzle comprising:

- a body having a passage and an input port for the fluid, the passage being fluidly connected to the input port and having an output opening for discharging the fluid on the component;
- first and second opposed side members received in the passage and movably connected to the body allowing the side members to move toward and away from each other;
- at least one roller rotatably attached to each of the side members; and
- at least one bias element attached to the side members and configured to urge the side members toward each other, wherein the side members are configured to adjust the size of the output opening based on the distance between the opposed surfaces.

D1. The adjustable nozzle of paragraph D0, wherein the side members are further configured to shape at least a portion of a bead of the viscous fluid applied to the component.

D2. The adjustable nozzle of any of paragraphs D0-D1, further comprising a roller attached to the body and configured to roll on the primary surface and to place the adjustable nozzle in a position to apply fluid on the primary surface when the at least a third roller is rolled on the primary surface.

Manner of Operation/Use

In one example, an edge of a component may need to be sealed with a sealant. For example, composite structure fuel tanks may be supported by one or more structural spar members. The spar member may include a matrix (or bond) material, such as a resin (e.g., thermoset epoxy) and a reinforcement material, such as a plurality of fibers (e.g., a woven layer of carbon fibers). During the manufacturing process of the spar member, the spar member may be trimmed to the required final dimensions. The trimming process may leave a cut edge in which individual reinforcing fibers at the edge are no longer covered and sealed by the resin, but rather exposed to the surrounding environment. An edge seal may be applied to seal or cover the cut edge.

The structural spar member may be restrained with the cut edge oriented in a horizontal plane. A suitable sealant may be loaded into a body of a nozzle assembly or the nozzle assembly may be fluidly connected to a viscous fluid source. The nozzle assembly may be positioned adjacent the cut edge such that first and second contact members of the nozzle assembly contact opposed surfaces that are perpendicular to the cut edge. At least one bias element of the nozzle assembly may urge the first and second contact members toward the opposed surfaces to maintain contact with the opposed surfaces. The sealant may be applied forming an edge seal, which may include one or more overlapping portions on the opposed surfaces. The nozzle assembly may be moved along the cut edge while applying the sealant.

Advantages, Features, Benefits

The different embodiments of the systems, apparatuses, and methods for viscous fluid application described herein provide several advantages over known solutions for applying viscous fluids. For example, the illustrative embodiments of the systems, apparatuses, and methods for the application of viscous fluids to components described herein allow the application of viscous fluids to components with varying widths and/or contours at a much higher rate over known solutions. Additionally, and among other benefits, illustrative embodiments of the systems, apparatuses, and methods for viscous fluid application herein allow more accurate application of viscous fluids to components with varying widths and/or contours. No known system or device can perform these functions, particularly in edge sealing of composite structures. Thus, the illustrative embodiments described herein are particularly useful for sealing cut edges of composite structures. However, not all embodiments described herein provide the same advantages or the same degree of advantage.

CONCLUSION

The disclosure set forth above may encompass multiple distinct examples with independent utility. Although each of these examples has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed disclosure. The subject matter of the examples includes all novel and nonobvious combinations and subcombinations of the various elements, features, functions, and/or properties disclosed herein. The following claims particularly point out certain combinations and subcombinations regarded as novel and nonobvious. Examples embodied in other combinations and subcombinations of features, functions, elements, and/or properties may be claimed in applications claiming priority from this or a related application. Such claims, whether directed to a different example or to the same example, and whether broader, narrower, equal, or different in scope to the original claims, also are regarded as included within the subject matter of the examples of the present disclosure.

We claim:

1. An adjustable nozzle for applying viscous fluid to a component having a primary surface and opposed surfaces perpendicular to the primary surface, the adjustable nozzle comprising:

a body having a passage for receiving a viscous fluid;

first and second opposed side members at least partially received in the passage and slidably connected to the body;

a first contact element attached to the first side member;

a second contact element attached to the second side member; and at least one spring configured to urge the side members toward each other, the at least one spring having first and second end portions, the first end portion attached to the first side member and the second end portion attached to the second side member, wherein each of the first and second opposed side members includes first and second wing portions and a base portion disposed between the first and second wing portions, the base portion is configured to be slidably received in the passage, and the first and second wing portions are configured to be outside the passage, wherein the at least one spring includes first and second springs, respective ones of the first and second springs attached to respective ones of the first and second wing portions.

2. The adjustable nozzle of claim 1, wherein the first side member comprises a first shaping wall, the second side member comprises a second shaping wall, and the first shaping wall and the second shaping wall are configured to shape at least a portion of a bead of the viscous fluid applied to the component.

3. The adjustable nozzle of claim 1, wherein the first side member includes a first passage wall, the second side member includes a second passage wall, and the first passage wall and the second passage wall are configured to guide the viscous fluid to only the primary surface of the component.

4. The adjustable nozzle of claim 1, wherein the first side member comprises a first passage wall, the second side member comprises a second passage wall, and the first passage wall and the second passage wall are configured to guide the viscous fluid to only the primary surface and a portion of the opposed surfaces.

5. The adjustable nozzle of claim 1, wherein the body includes first and second opposed body walls at least partially defining the passage therebetween, one of the body walls including an opening configured to shape at least a portion of a bead of the viscous fluid.

6. The adjustable nozzle of claim 1, wherein the body includes first and second opposed body walls at least partially defining the passage therebetween, the first and second body walls comprise one of at least one slot or at least one protruding member, the side members comprise another one of the at least one slot or the at least one protruding member, and the at least one protruding member is configured to be slidably received in the at least one slot.

7. The adjustable nozzle of claim 1, wherein at least one of the first contact element and the second contact element is a roller.

8. The adjustable nozzle of claim 1, wherein the body comprises an input port for the viscous fluid, and the passage is connected to the input port.

9. The adjustable nozzle of claim 1, wherein the body comprises first and second opposed body walls at least partially defining the passage therebetween, the nozzle further comprises a roller attached to the body, and the roller has a rotation axis that is perpendicular to the first and second body walls.

10. A system for applying a viscous fluid to a component having a primary surface and opposed surfaces perpendicular to the primary surface, comprising:

a robotic arm;

a controller assembly configured to control the robotic arm; and the adjustable nozzle of claim 1 attached to the robotic arm, wherein the side members are configured to adjust a size of an output opening of the body responsive to variations in distance between the opposed surfaces of the component along a path defined by the primary surface of the component.

11. The system of claim 10, wherein the controller assembly is configured to move the nozzle along the primary surface via the robotic arm.

* * * * *